US005884609A

United States Patent [19]

Kawamoto et al.

[11] Patent Number: 5,884,609

[45] Date of Patent: Mar. 23, 1999

[54] AIR/FUEL RATIO CONTROL APPARATUS

[75] Inventors: Yutaka Kawamoto; Atsushi Iochi; Hiroshi Kuriki, all of Yokohama, Japan

[73] Assignee: Nissan Motor Co., Ltd., Kanagawa, Japan

[21] Appl. No.: 881,289

[22] Filed: Jun. 24, 1997

Related U.S. Application Data

[62] Division of Ser. No. 752,883, Nov. 20, 1996, Pat. No. 5,785,033, which is a division of Ser. No. 689,116, Jul. 30, 1996, Pat. No. 5,694,911, which is a division of Ser. No. 434,799, May 4, 1995, Pat. No. 5,623,914.

[30] Foreign Application Priority Data

May 9, 1994 [JP] Japan ..... 6-95344
Jun. 30, 1994 [JP] Japan ..... 6-149625

[51] Int. Cl.[6] ..... F02M 25/08

[52] U.S. Cl. ..... 123/520

[58] Field of Search ..... 123/518, 519, 123/520, 698

[56] References Cited

U.S. PATENT DOCUMENTS

| | | | |
|---|---|---|---|
| 4,130,095 | 12/1978 | Bowler et al. | 123/675 |
| 5,044,341 | 9/1991 | Henning et al. | 123/520 X |
| 5,176,123 | 1/1993 | Hosoda et al. | 123/520 |
| 5,188,085 | 2/1993 | Habaguchi et al. | 123/520 |
| 5,273,018 | 12/1993 | Suzuki | 123/520 |
| 5,299,544 | 4/1994 | Kitamoto et al. | 123/520 |
| 5,406,927 | 4/1995 | Kato et al. | 123/674 |
| 5,469,833 | 11/1995 | Hara et al. | 123/698 |
| 5,474,049 | 12/1995 | Nagaishi et al. | 123/520 |
| 5,520,160 | 5/1996 | Aota et al. | 123/520 X |
| 5,544,638 | 8/1996 | Yuda | 123/674 |

FOREIGN PATENT DOCUMENTS 4-109050 4/1992 Japan .

*Primary Examiner*—Tony M. Argenbright
*Attorney, Agent, or Firm*—McDermott, Will & Emery

[57] ABSTRACT

Fuel vapor is produced in a fuel tank and absorbed in a canister. The absorbed fuel vapor is purged through a purge passage into an engine induction passage under predetermined engine operating conditions. A purge valve is provided in the purge passage to regulate the supply of gaseous mixture, including the absorbed fuel vapor, into the engine. A purge rate factor is determined corresponding to the concentration of evaporated fuel in the gaseous mixture. The concentration is determined utilizing the temperature of the fuel in the fuel tank.

7 Claims, 30 Drawing Sheets

AIR/FUEL RATIO CONTROL APPARATUS

This application is a division of application Ser. No. 08/752,883, filed Nov. 20, 1996, now U.S. Pat. No. 5,785,033; which is a division of application Ser. No. 08/689,116, filed Jul. 30, 1996, now U.S. Pat. No. 5,694,913; which is a division of Application Ser. No. 08/434,799, filed May 4, 1995, now U.S. Pat. No. 5,623,914.

BACKGROUND OF THE INVENTION

This invention relates to an apparatus for controlling the air/fuel ratio of an air/fuel mixture supplied to an internal combustion engine associated with an evaporated fuel purging unit.

It is the current practice to avoid discharge of fuel evaporated in the fuel tank to the atmosphere with the use of a canister having an absorbent therein for accumulating the fuel vapor introduced from the fuel tank into the canister. Fresh air is introduced into the canister to purge the accumulated fuel vapor from the absorbent and introduced the purge (or purged) fuel vapor, along with the fresh air, into the engine induction passage. In order to correct deviations of the air/fuel ratio from stoichiometry due to variations and changes in the fuel injectors and airflow meter with time, the air/fuel ratio is learned to update the last air/fuel ratio for air/fuel ratio feedback control. During the learning control, however, an error will be introduced into the learned air/fuel ratio value when the fuel vapor is introduced from the canister to the engine.

For example, Japanese Patent Kokai No. 4-109050 discloses an air/fuel ratio control apparatus adapted to inhibit the air/fuel ratio learning control when the fuel vapor is purged from the canister and introduced into the engine. This condition is judged when the rate of temperature decrease of the absorbent placed in the canister exceeds a predetermined value. However, the air/fuel ratio learning control is influenced not only by (1) fuel vapor purged from the canister, but also by (2) fuel vapor introduced from the fuel tank into the engine without absorption in the canister. The second case occurs at high fuel temperatures and cannot be judged from the absorbent temperature.

SUMMARY OF THE INVENTION

A main object of the invention is to provide an air/fuel ratio control method and apparatus which can inhibit air/fuel ratio learning control to avoid errors introduced into the air/fuel ratio learning control at high fuel temperatures.

There is provided, in accordance with the invention, an apparatus for controlling the air/fuel ratio of an air/fuel mixture supplied to an internal combustion engine installed on an automotive vehicle. The engine has a throttle valve located in an induction passage for controlling the amount of air supplied to the engine through the induction passage and an exhaust passage through which exhaust gases are discharged from the engine to the atmosphere. The engine is associated with an evaporated fuel purging unit having a canister adapted to accumulate evaporated fuel introduced thereinto from a fuel tank and a purge passage connecting the canister to the induction passage at a position downstream of the throttle valve to purge the accumulated evaporated fuel. The air/fuel ratio control apparatus comprises a sensor sensitive to an oxygen content of the exhaust gases for producing a signal indicative of a sensed oxygen content, a sensor sensitive to a fuel temperature in the fuel tank for producing a signal indicative of a sensed fuel temperature, means for calculating a basic value for fuel delivery requirement based on engine operating conditions, means for calculating an air/fuel ratio feedback correction factor based on the sensed oxygen content, a memory having map areas specified by engine operating conditions for storing respective learned air/fuel ratio values, means for reading a learned air/fuel ratio value from the map area specified by the engine operating conditions, means for correcting the calculated basic value based on the read air/fuel ratio value and the calculated air/fuel ratio feedback correction factor to calculate a target value for fuel delivery requirement, means for producing an inhibition signal during a air/fuel ratio feedback control when the sensed fuel temperature exceeds a reference value, and means for updating the learned air/fuel ratio value based on the air/fuel ratio feedback correction factor during the air/fuel ratio feedback control only in the absence of the inhibition signal.

According to another aspect of the invention, there is provided an apparatus for controlling the air/fuel ratio of an air/fuel mixture supplied to an internal combustion engine having a throttle valve located in an induction passage for controlling the amount of air supplied to the engine through the induction passage. The engine is associated with an evaporated fuel purging unit having a canister adapted to accumulate evaporated fuel introduced thereinto from a fuel tank and a purge passage connecting the canister to the induction passage at a position downstream of the throttle valve to purge the accumulated evaporated fuel. The air/fuel ratio control apparatus comprises a purge value provided in the purge passage for movement between open and closed positions, the purge value opening the purge passage at the open position and closing the purge passage at the closed position, sensor means sensitive to engine operating conditions for producing signals indicative of sensed engine operating conditions, means sensitive to an air/fuel ratio at which the engine is operating for producing a signal indicative of the sensed air/fuel ratio, means for calculating a basic value for fuel delivery requirement based on the sensed engine operating conditions, means for calculating a target air/fuel ratio value based on the sensed engine operating conditions, means for calculating a feedback correction factor based on a deviation of the sensed air/fuel ratio from the calculated target air/fuel ratio value, means for correcting the calculated fuel delivery requirement basic value based on the calculated feedback correction factor to calculate a required value for fuel delivery requirement, means for supplying fuel to the engine in an amount corresponding to the required value, and means for setting the feedback correction factor at an initial value in response to a movement of the purge valve from the open position toward the closed position.

According to another aspect of the invention, there is provided an apparatus for controlling the air/fuel ratio of an air/fuel mixture supplied to an internal combustion engine having a throttle valve located in an induction passage for controlling the amount of air supplied to the engine through the induction passage. The engine is associated with an evaporated fuel purging unit having a canister adapted to accumulate evaporated fuel introduced thereinto from a fuel tank and a purge passage connecting the canister to the induction passage at a position downstream of the throttle valve to purge the accumulated evaporated fuel. The air/fuel ratio control apparatus comprises a purge value provided in the purge passage for movement between open and closed positions, the purge value opening the purge passage at the open position and closing the purge passage at the closed position,. sensor means sensitive to engine operating conditions for producing signals indicative of sensed engine operating conditions, means sensitive to an air/fuel ratio at which the engine is operating for producing a signal indicative of the sensed air/fuel ratio, means for calculating a basic value for fuel delivery requirement based on the sensed engine operating conditions, means for calculating a target air/fuel ratio value based on the sensed engine operating conditions, means for calculating a feedback correction factor $\alpha$ based on a deviation of the sensed air/fuel ratio from the calculated target air/fuel ratio value, means for correcting the calculated fuel delivery requirement basic value based on the calculated feedback correction factor $\alpha$ to calculate a required value for fuel delivery requirement, means for supplying fuel to the engine in an amount corresponding to the required value, means for storing a value $\alpha m$ of feedback correction factor calculated when the purge valve is at the open position, and means for setting the feedback correction factor $\alpha$ at the stored feedback correction factor value $\alpha m$ in response to a movement of the purge value from the closed position to the open position.

According to another aspect of the invention, there is provided an apparatus for controlling the air/fuel ratio of an air/fuel mixture supplied to an internal combustion engine having a throttle valve located in an induction passage for controlling the amount of air supplied to the engine through the induction passage. The engine is associated with an evaporated fuel purging unit having a canister adapted to accumulate evaporated fuel introduced thereinto from a fuel tank and a purge passage connecting the canister to the induction passage at a position downstream of the throttle valve to purge the accumulated evaporated fuel, the air/fuel ratio control apparatus comprises a purge value provided in the purge passage for movement between open and closed positions, the purge value opening the purge passage at the open position and closing the purge passage at the closed position, sensor means sensitive to engine operating conditions for producing signals indicative of sensed engine operating conditions, means sensitive to an air/fuel ratio at which the engine is operating for producing a signal indicative of the sensed air/fuel ratio, means for calculating a basic value for fuel delivery requirement based on the sensed engine operating conditions, means for calculating a target air/fuel ratio value based on the sensed engine operating conditions, means for calculating a feedback correction factor $\alpha$ based on a deviation of the sensed air/fuel ratio from the calculated target air/fuel ratio value,. means for correcting the calculated fuel delivery requirement basic value based on the calculated feedback correction factor $\alpha$ to calculate a required value for fuel delivery requirement, means for supplying fuel to the engine in an amount corresponding to the required value, and means for storing a value am of feedback correction factor calculated when the purge valve is at the open position, and means for calculating the feedback correction factor $\alpha$ as $\alpha=\alpha 1+(\alpha m-\alpha 1)\cdot H$ where $\alpha 1$ is an initial value and H is a constant in response to a movement of the purge value from the open position to the closed position.

According to another aspect of the invention, there is provided an apparatus for controlling the air/fuel ratio of an air/fuel mixture supplied to an internal combustion engine having a throttle valve located in an induction passage for controlling the amount of air supplied to the engine through the induction passage. The engine is associated with an evaporated fuel purging unit having a canister adapted to accumulate evaporated fuel introduced thereinto from a fuel tank and a purge passage connecting the canister to the induction passage at a position downstream of the throttle valve to purge the accumulated evaporated fuel. The air/fuel ratio control apparatus comprises a purge value provided in the purge passage for movement between open and closed positions, the purge value opening the purge passage at the open position and closing the purge passage at the closed position, sensor means sensitive to engine operating conditions for producing signals indicative of sensed engine operating conditions, means sensitive to an air/fuel ratio at which the engine is operating for producing a signal indicative of the sensed air/fuel ratio, means for calculating a basic value for fuel delivery requirement based on the sensed engine operating conditions, means for calculating a target air/fuel ratio value based on the sensed engine operating conditions, means for calculating a feedback correction factor $\alpha$ based on a deviation of the sensed air/fuel ratio from the calculated target air/fuel ratio value, means for correcting the calculated fuel delivery requirement basic value based on the calculated feedback correction factor $\alpha$ to calculate a required value for fuel delivery requirement, means for supplying fuel to the engine in an amount corresponding to the required value, means for storing a value $\alpha m$ of feedback correction factor calculated when the purge valve is at the closed position, and means for calculating the feedback correction factor $\alpha$ as $\alpha=\alpha 1+(\alpha m-\alpha 1)\cdot H$ where $\alpha 1$ is an initial value and H is a constant in response to a movement of the purge value from the closed position to the open position.

According to still another aspect of the invention, there is provided an apparatus for controlling the air/fuel ratio of an air/fuel mixture supplied to an internal combustion engine having a throttle valve located in an induction passage for controlling the amount of air supplied to the engine through the induction passage. The engine is associated with an evaporated fuel purging unit having a canister adapted to accumulate evaporated fuel introduced thereinto from a fuel tank and a purge passage connecting the canister to the induction passage at a position downstream of the throttle valve to purge the accumulated evaporated fuel. The air/fuel ratio control apparatus comprises a purge value provided in the purge passage for movement between open and closed positions, the purge value opening the purge passage at the open position and closing the purge passage at the closed position, sensor means sensitive to engine operating conditions for producing signals indicative of sensed engine operating conditions, means sensitive to an air/fuel ratio at which the engine is operating for producing a signal indicative of the sensed air/fuel ratio, means for calculating a basic value for fuel delivery requirement based on the sensed engine operating conditions, means for calculating a target air/fuel ratio value based on the sensed engine operating conditions, means for calculating a feedback correction factor $\alpha$ based on a deviation of the sensed air/fuel ratio from the calculated target air/fuel ratio value, means for correcting the calculated fuel delivery requirement basic value based on the calculated feedback correction factor $\alpha$ to calculate a required value for fuel delivery requirement, means for supplying fuel to the engine in an amount corresponding to the required value, means sensitive to a small rate of change of purge valve position for detecting initiation or termination of a fuel purging operation, means sensitive to a great rate of change of purge valve position for detecting a leakage checking operation, and means for performing air/fuel ratio feedback control during the detected fuel purging operation and correcting the feedback correction factor in response to a movement of the purge valve during the detected leakage checking operation.

BRIEF DESCRIPTION OF THE DRAWINGS

The invention will be described in greater detail by reference to the following description taken in connection with the accompanying drawings, in which.

DETAILED DESCRIPTION OF THE INVENTION

Figure 1:
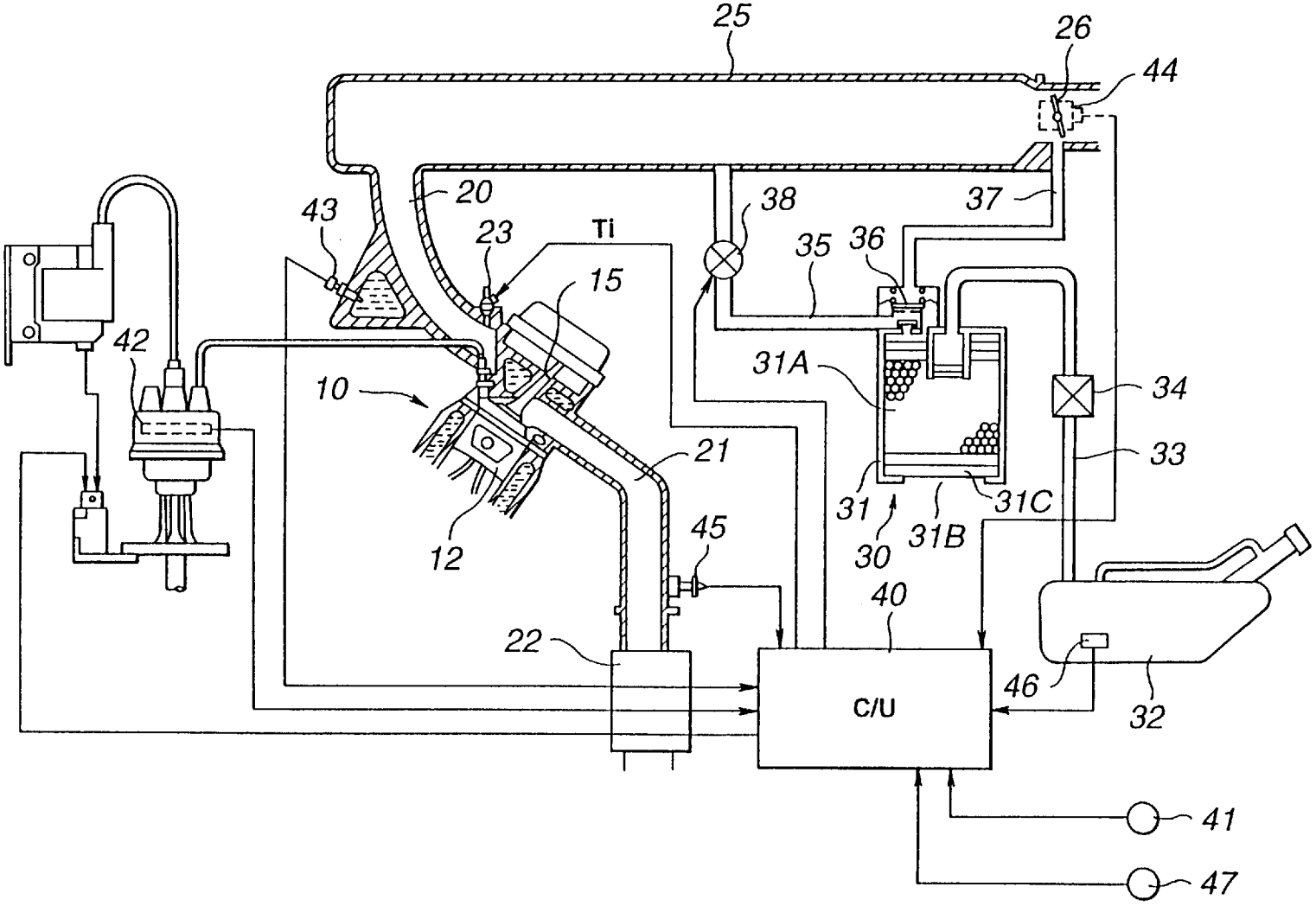
FIG. 1 is a schematic diagram showing one embodiment of an air/fuel ratio control apparatus made in accordance with the invention.

With reference to the drawings, and in particular to FIG. 1, there is shown a schematic diagram of an air/fuel ratio control apparatus embodying the invention. An internal combustion engine, generally designated by the numeral 10, for an automotive vehicle includes combustion chambers or cylinders, one of which is shown. A crankshaft (not shown) is supported for rotation with the engine 10 in response to reciprocation of the piston 12 within the cylinder. An intake manifold 20 is connected with the cylinder through an intake port with which an intake valve (not shown) is in cooperation for regulating the entry of combustion ingredients into the cylinder from the intake manifold 20. An exhaust manifold 21 is connected with the cylinder through an exhaust port with which an exhaust valve 15 is in cooperation for regulating the exit of combustion products, exhaust gases, from the cylinder into the exhaust manifold 21. The exhaust gases are discharged to the atmosphere through an. exhaust duct having a three-way catalytic converter 22. The intake and exhaust valves are driven through a suitable linkage with the crankshaft.

A fuel injector 23 is mounted for injecting fuel into the intake manifold 20 toward the intake valve. The fuel injector 23 opens to inject fuel into the intake manifold 20 when it is energized by the presence of electrical signal Ti. The length of electrical pulse, that is, the pulse-width, applied to the fuel injector 23 determines the length of time the fuel injector 23 opens and, thus, determines the amount of fuel injected into the intake manifold 20. Air to the engine 10 is supplied through an air cleaner (not shown) into an induction passage 25. The amount Q of air permitted to enter the combustion chamber through the intake manifold 20 is controlled by a butterfly throttle valve 26 located within the induction passage 25. The throttle valve 26 is connected by a mechanical linkage to an accelerator pedal (not shown). The degree to which the accelerator pedal is depressed controls the degree of rotation of the throttle valve 26.

The engine 10 is associated with an evaporated fuel purging unit, generally designated by the numeral 30, which includes a canister 31 employing an absorbent 31A, such for example as activated charcoal, for accumulating or absorbing evaporated fuel introduced thereinto from a fuel tank 32. For this purpose, the canister 31 has an inlet port connected through an evaporated fuel passage 33 to the upper space of the fuel tank 32. The evaporated fuel passage 33 has a check valve 34 which permits the evaporated fuel to flow from the fuel tank 32 to the canister 31 when the evaporated fuel pressure exceeds a predetermined value while preventing back-flow. The canister 31 also has an outlet port connected through a purge passage 35 to the induction passage 25 at a position downstream of the throttle valve 26. The canister 31 has a purge or purging air inlet 31B connected to the atmosphere through a filter 31C. A flow control valve 36, which is provided in the purge passage 35, operates on a command from a control unit 40 to open and close the purge passage 35. The flow control valve 36 operates in response to a negative pressure introduced thereinto through a port 37 which opens into the induction passage 25 near the throttle valve 26. Thus, the flow control valve 36 opens at intermediate engine loads where the negative pressure introduced through the port 37 increases with respect to the intake manifold negative pressure introduced into the purge passage 35. When the flow control valve 36 opens, fresh air is introduced through the purge air inlet 31B to purge the fuel vapor absorbed by the absorbent 31A. The purged fuel vapor is introduced, along with the air, through the purge passage 35 to the induction passage 25. The numeral 38 designates a normally closed purge cut valve which opens in response to a command from the control unit 40.

The amount of fuel metered to the engine, this being determined by the width of the electrical pulse Ti applied to the fuel injector 23 is repetitively determined from calculations performed by the control unit 40, these calculations being based upon various conditions of the engine that are sensed during its operation. The flow cross sectional area of the purge passage 35, this being determined by the duty (DUTY) of the control signal applied to the flow control valve 36 is repetitively determined from calculations performed by the control unit 40, these calculations being based upon various conditions of the engine that are sensed during its operation. These conditions include intake air flow rate Qa, engine speed Ne, engine coolant temperature Tw, throttle valve position, oxygen content, fuel temperature and atmospheric pressure. Thus, an airflow meter 41, a crankshaft position sensor 42, an engine coolant temperature sensor 43, a throttle position sensor 44, an oxygen sensor 45, a fuel temperature sensor 46 and an atmospheric pressure sensor 47 are connected to the control unit 40. The airflow meter 41 is provided to detect the amount Qa of air permit to enter the induction passage 25 and it produces a signal indicative of the detected intake air flow rate Q. The crankshaft position sensor 42 produces a series of crankshaft position electrical pulses, each corresponding to one degree of rotation of the engine crankshaft, of a repetition rate directly proportional to engine speed Ne and a reference electrical pulse Ref at a predetermined number of degrees (for example, 180° for four-cylinder engines and 120° for six-cylinder engines). The engine coolant temperature sensor 43 is provided to sense the temperature Tw of the engine coolant and it produces a signal indicative of the sensed engine coolant temperature. The throttle position sensor 44 is associated with the throttle valve 26 and it produces a signal when the throttle valve 26 is at its fully closed position. The oxygen sensor 45 is located in the engine exhaust duct to provide a feedback signal used to ensure that the fuel supplied to the engine is correct to maintain a desired optimum air/fuel ratio. The fuel temperature sensor 46 is provided to sense the temperature TFN of fuel contained in the fuel tank 32 and it produces a signal indicative of the sensed fuel temperature. The atmospheric pressure sensor 47 is provided to detect the atmospheric pressure Pa and it produces a signal indicative of the detected atmospheric pressure.

The control unit 40 may employ a digital computer which includes a central processing unit (CPU), a random access memory (RAM), a read only memory (ROM), and an input/output control circuit (I/O). The central processing unit communicates with the rest of the computer via data bus. The input/output control circuit includes a counter which counts the reference pulses fed from the crankshaft position sensor 42 and converts its count into an engine speed indication digital signal for application to the central processing unit. The input/output control circuit also includes an analog-to-digital converter which receives analog signals from the flow meter 41 and the other sensors and converts them into digital form for application to the central processing unit. The read only memory contains the program for operating the central processing unit and further contains appropriate data in look-up tables used in calculating appropriate values for fuel delivery requirements and purge rates. Control words specifying desired fuel delivery requirements and purge rates are periodically transferred by the central processing unit to the fuel-injection and purge control circuits included in the input/output control circuit. The fuel injection control circuit converts the received control word into a fuel injection pulse signal for application to the fuel injector 23. The fuel injector 23 opens for a time period determined by the width of the fuel injection control pulse signal. The purge control circuit converts the received control word into a drive pulse signal for application to the flow control valve 36. The flow control valve 36 opens and closes at a duty determined by the drive pulse signal.

Figure 2:
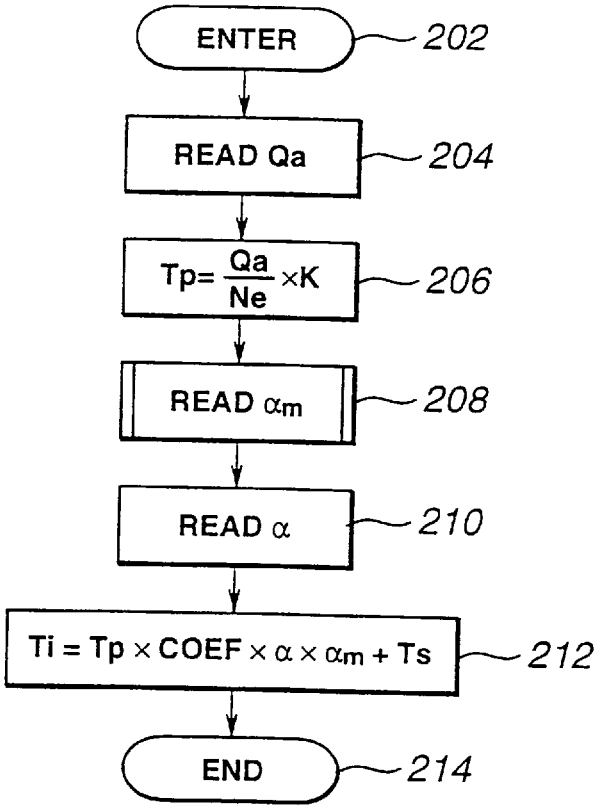
FIG. 2 is a flow diagram showing the programming of the digital computer as it is used to calculated a desired value for fuel-injection pulse-width.

FIG. 2 is a flow diagram illustrating the programming of the digital computer as it is used to calculate a desired value for fuel delivery requirement in the form of fuel-injection pulse-width. The computer program is entered at the point 202 at uniform time intervals, for example, 10 milliseconds. At the point 204 in the program, the voltage signal fed from the airflow meter 41 is converted into a corresponding digital mass flow rate value Qa. The converted value Qa is read into the computer memory. At the point 206, a basic value Tp for fuel-injection pulse-width is calculated as $Tp=K\times Qa/Ne$ where Ne is the engine speed and K is a constant. At the point 208 in the program, a learned value am of basic air/fuel ratio is calculated.

Figure 3:
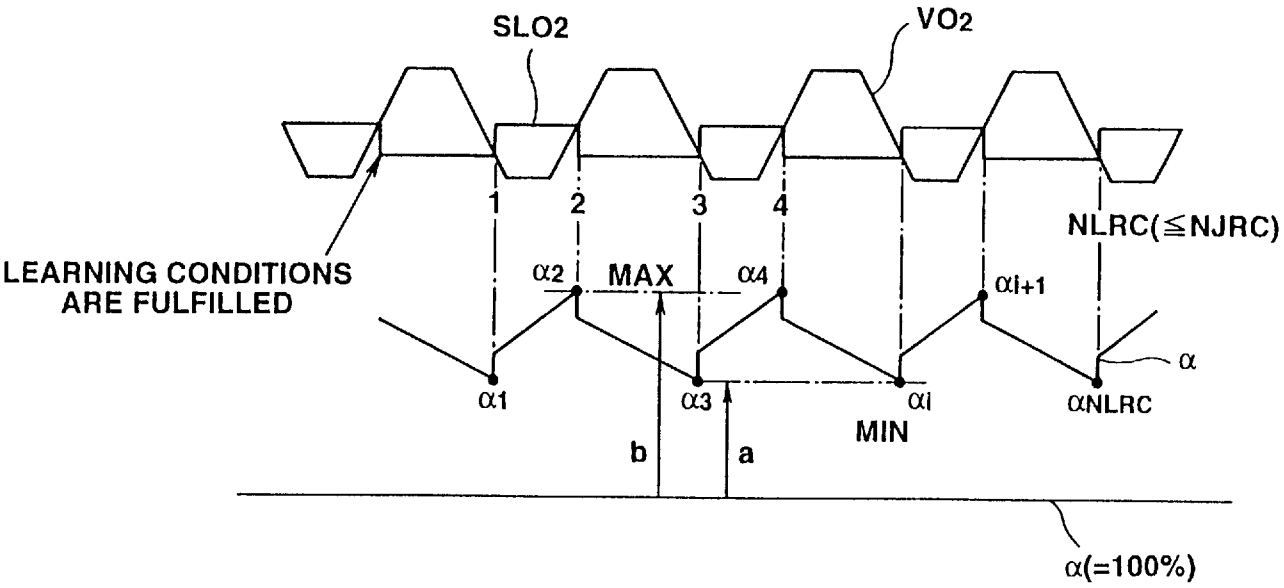
FIG. 3 is a graph used in explaining the air/fuel ratio learning operation.

At the point 210, an air/fuel ratio feedback correction factor a is read into the computer memory. The air/fuel ratio feedback control employs a closed loop signal containing integral plus proportional terms generated in response to the sensed deviation of the air/fuel ratio from stoichiometry. The air/fuel ratio has a value richer than stoichiometry when the signal outputted from the oxygen sensor 45 has a value $VO_2$ greater than a slice level SLO2, and it has a value leaner than stoichiometry when $VO_2<SLO2$. The air/fuel ratio feedback correction factor a is updated by subtracting a proportional term P from the last feedback correction factor $\alpha$ when the air/fuel ratio changes from a leaner value to a richer value, and by subtracting an integral term I from the last air/fuel ratio feedback correction factor $\alpha$ when the air/fuel ratio remains at a richer value. Similarly, the air/fuel ratio feedback correction factor $\alpha$ is updated by adding the proportional term P to the last feedback correction factor $\alpha$ when the air/fuel ratio changes from a richer value to a leaner value, and by adding an integral term I to the last air/fuel ratio feedback correction factor $\alpha$ when the air/fuel ratio remains at a leaner value. It is possible to retain the averaged air/fuel ratio within a predetermined window by repeating these updating operations to change the air/fuel ratio feedback correction factor $\alpha$ periodically within a certain range, as shown in FIG. 3. The proportional and integral terms may be calculated from look-up tables programmed into the computer.

At the point 212 in the program, a target value Ti for fuel-injection pulse-width is calculated as $Ti=Tp\times COFE\times \alpha\times\alpha m\times Ts$ where Tp is the basic value for fuel-injection pulse-width, COEF is various correction factors, $\alpha$ is the air/fuel ratio feedback correction factor, $\alpha m$ is the basic air/fuel ratio learned value, and Ts is the ineffective pulse width. The calculated target value Ti is transferred to the input/output control circuit (I/O) in synchronism with the reference pulse signal Ref. Following this, the program proceeds to the end point 214.

Figure 4:
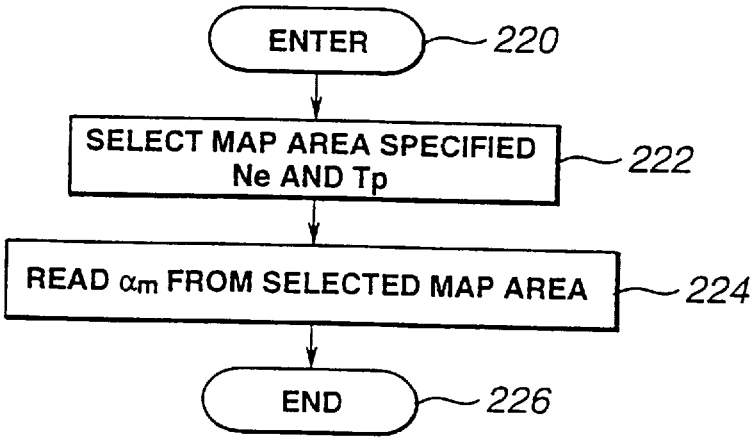
FIG. 4 is a flow diagram showing the programming of the digital computer as it is used to learn a basic air/fuel ratio value.
Figure 5:
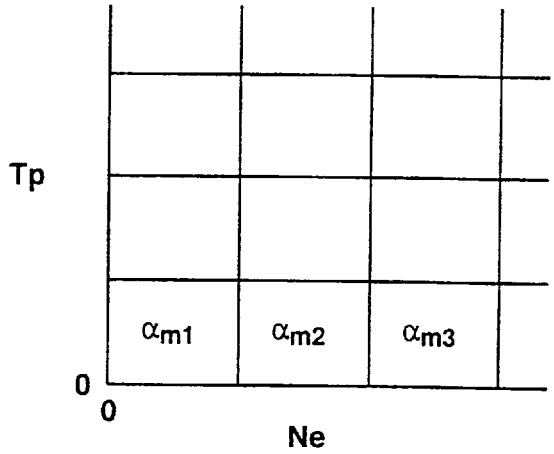
FIG. 5 is a diagram showing a look-up table having map areas for storing respective learned basic air/fuel ratio values.

FIG. 4 is a flow diagram illustrating the programming of the digital computer as it is used to calculate a learned value $\alpha m$ of basic air/fuel ratio. This program is entered at the point 222 which corresponds to the point 208 of FIG. 2. At the point 222 in the program, a map area specified by the engine speed Ne and the basic fuel-injection pulse-width value Tp, as shown in FIG. 5, is selected. This selection is made based on the sensed engine speed Ne and the basic fuel-injection pulse-width value Tp calculated at the point 206 of FIG. 2. At the point 224, a learned value am stored in the selected map area is read into the computer memory. Following this, the program proceeds to the end point 226 which corresponds to the point 210 of FIG. 2.

The basic air/fuel ratio is learned in order to prevent the averaged air/fuel ratio value from shifting out of the window because of variations and changes in the characteristics of the fuel injector 23 and airflow meter 41 with time. It may be considered to avoid an error introduced into the learned basic air/fuel ratio value by inhibiting the updating operation during fuel purging operation. Although an absorbent temperature drop can indicate the fuel vapor purged from the canister 31, it cannot indicate the fuel vapor produced in the fuel tank 32 and introduced into the induction passage 25 without absorption in the absorbent 31A. In this embodiment, the control unit 40 judges a great amount of fuel vapor produced in the fuel tank 32 and inhibits the learning operation when the temperature of fuel contained in the fuel tank 32 is higher than a predetermined value.

Figure 6:
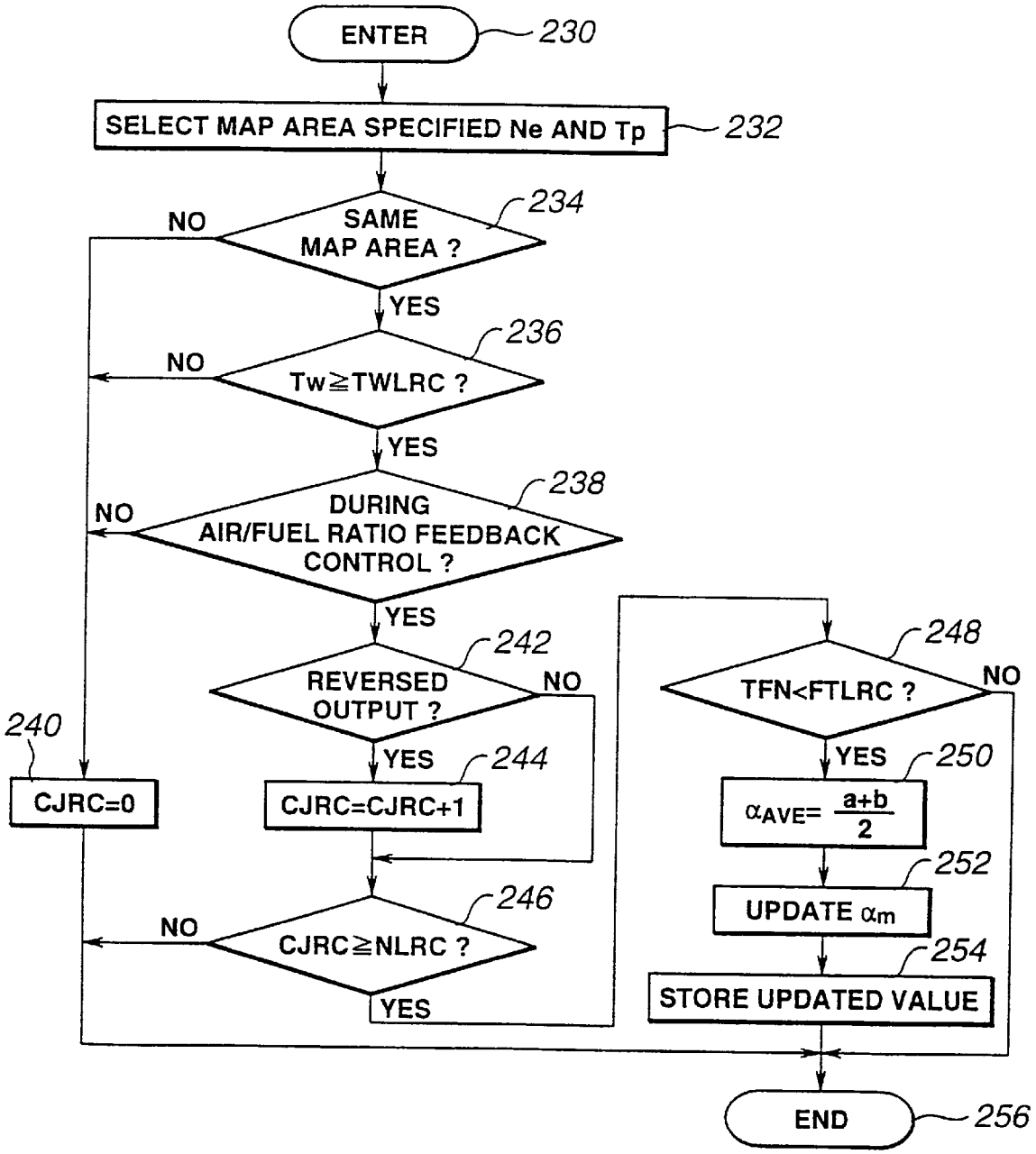
FIG. 6 is a flow diagram showing the programming of the digital computer as it is used to update the learned basic air/fuel ratio value.

FIG. 6 is a flow diagram illustrating the programming of the digital computer as it is used to update the learned value $\alpha m$. The computer program is entered at the point 230 in synchronism with the reference pulse signal Ref. At the point 232 in the program, a map area having a learned basic air/fuel ratio value am stored therein is selected based on the sensed engine speed Ne and the calculated basic fuel-injection pulse-width value Te. At the point 234, a determination is made as to whether or not the selected map area is the same as the map area selected in the last cycle of execution of this program. If the answer to this question is "yes", then the program proceeds to the point 236. Otherwise, the program proceeds to the point 240.

At the point 236 in the program, a determination is made as to whether or not the sensed engine coolant temperature Tw is a predetermined value TWLRC. If the answer to this question is "yes", then the program proceeds to the point 238. Otherwise, the program proceeds to the point 240. At the point 238, a determination is made as to whether or not the air/fuel ratio feedback control is made. The air/fuel ratio feedback control is inhibited when four conditions are fulfilled, that is, when the engine is starting, the engine coolant temperature is lower than a predetermined value, the engine is operating at a high load, and the engine is idling. When each of these four conditions is not fulfilled, the answer to this question is "yes" and the program proceeds to the point 242. Otherwise, the program proceeds to the point 240 where the count CJRC is cleared to zero and then to the end point 256.

When the three conditions are fulfilled, that is, when the selected map area is the same as the map area selected in the last cycle of execution of this program, the sensed engine coolant temperature Tw is a predetermined value TWLRC, and the air/fuel ratio feedback control is made, at the point 242, a determination is made as to whether or not the oxygen sensor 45 produces a reversed output. If the answer to this question is "yes", then the program proceeds to the point 236 where the count CJRC is incremented by one step and then to the point 246. Otherwise, the program proceeds directly to the point 246. At the point 246 in the program, a determination is made as to whether or not the count CJRC is equal to or greater than a predetermined value (two or more) NLRC. If the answer to this question is "yes", then the program proceeds to the point 248. If CJRC<NLRC, then the program proceeds to the end point 256.

At the point 248 in the program, a determination is made as to whether or not the sensed fuel temperature TFN is lower than a reference value, for example, 45° C. If the answer to this question is "yes", then the program proceeds to the point 250. Otherwise, it means that a great amount of fuel vapor is produced in the fuel tank 32 and the program proceeds to the end point 256. At the point 250, the average value $\alpha_{AVE}$ [%] of the air/fuel ratio feedback correction factor $\alpha$ is calculated as $\alpha_{AVE}=(a+b)/2$ wherein a and b are the minimum and maximum values of the air/fuel ratio feedback correction factors $\alpha_1, \alpha_2, \ldots \alpha_{NLCR}$. At the point 252 in the program, the learned value am is updated, based on the deviation between the average value $\alpha_{AVE}$ and the central value 100%, as $\alpha m=\alpha m+G1\times(\alpha_{AVE}-100)$ where G1 is a positive proportional constant. At the point 254, the updated learned value is stored in the same map area.

In this embodiment, the learned value $\alpha m$ is corrected to a smaller value causing a reduction in the amount of fuel metered to the engine when the average value $\alpha_{AVE}$ is less than 100%, that is, when the average air/fuel ratio is richer than stoichiometry. The learned value am is corrected to a greater value causing an increase in the amount of fuel metered to the engine when the average value $\alpha_{AVE}$ is greater than 100%, that is, when the average air/fuel ratio is leaner than stoichiometry. The learned values are retained in the computer memory after the engine stops.

The air/fuel ratio learning operation is inhibited when the fuel temperature TFN exceeds a predetermined value FTLRC indicating a great amount of fuel vapor produced in the fuel tank 32. The air/fuel ratio value is updated when the fuel temperature TFN is within a temperature range (FTEMP<FTLRC) where the amount of fuel vapor produced in the fuel tank 32 is small. This is effective to increase the frequency at which the air/fuel ratio is updated or learned as compared to the case where the air/fuel ratio learning operation is inhibited during fuel purging operation regardless of the amount of fuel vapor produced in the fuel tank 32.

Figure 7:
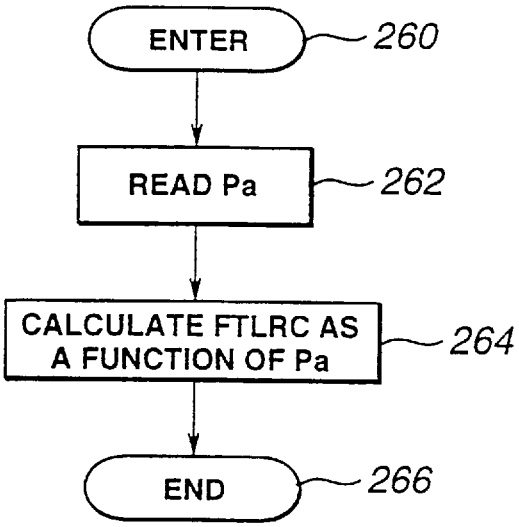
FIG. 7 is a flow diagram showing the programming of the digital computer as it is used to calculate the reference temperature value.
Figure 8:
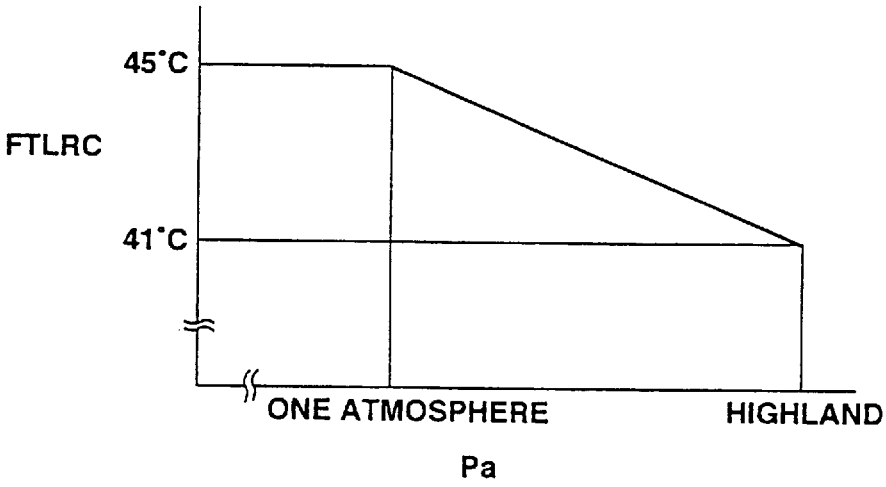
FIG. 8 is a graph showing a look-up table which defines the reference temperature value as a function of atmospheric pressure.

FIG. 7 is a flow diagram illustrating the programming of the digital computer as it is used to calculate the reference value FTLRC. The computer program is entered at the point 260 at uniform time intervals. At the point 262 in the program, the sensed atmospheric pressure Pa is read into the computer memory. At the point 264, The reference value FTLRC is calculated from a look-up table programmed into the computer. The look-up table defines the reference value FTLRC as a function of atmospheric pressure Pa, as shown in FIG. 8. The reference value FTLRC is a constant value of 45° C. when the atmospheric pressure Pa is less than one atmosphere and it decreases as the atmospheric pressure Pa decreases.

Figure 9:
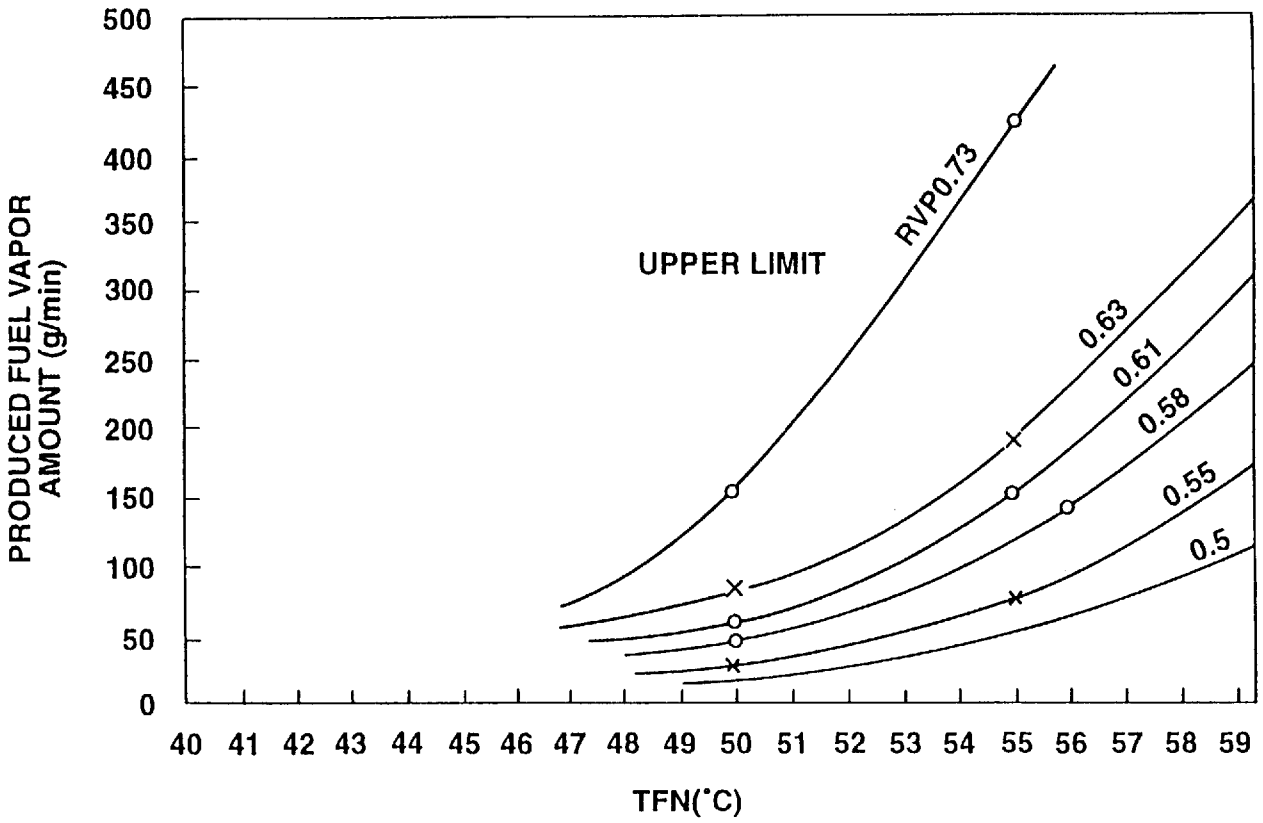
FIG. 9 is a graph showing variations in the amount of fuel vapor produced in the fuel tank with respect to the fuel temperature.

FIG. 9 shows variations in the amount [g/min] of fuel vapor produced in the fuel tank 32 with respect to the fuel temperature TFN. It can be seen from a study of FIG. 9 that a rapid rate of change occurs in the amount of fuel vapor produced in the fuel tank 32 when the fuel temperature TFN exceeds a certain value. The rate of change in the amount of fuel vapor produced in the fuel tank 32 increases for the same fuel temperature as the saturated fuel vapor partial pressure RVP increases. This leads to the fact that a rapid rate of change occurs in the amount of fuel vapor produced in the fuel tank 32 around 47° C. for the fuel available in the market when the saturated fuel vapor partial pressure is at maximum. For this reason, the reference value FTLRC for one atmosphere is set at 45° C. to leave a margin.

The saturated fuel vapor partial pressure increases and the temperature at which a rapid rate of change occurs in the amount of fuel vapor produced in the fuel tank 32 decreases, for example, to 41° C. when the vehicle is on a hill, that is, a low atmospheric pressure. If the learning operation is inhibited in such a case for such a reason that the fuel temperature TFN is lower than 45° C., an error is introduced into the learned value when the fuel temperature TFN is in the range of 41° C. to 45° C. For this reason, it is required to decrease the reference value FTLRC as the atmospheric pressure Pa decreases, as shown in FIG. 8.

Figure 10:
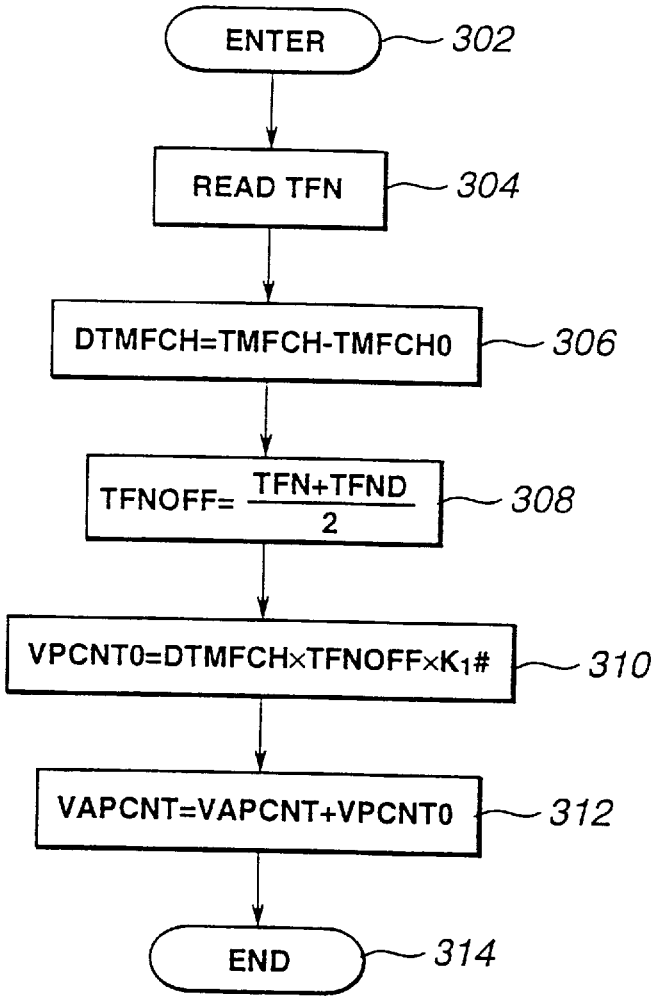
FIG. 10 is a flow diagram showing the programming of the digital computer as it is used to estimate the amount of fuel vapor produced in the fuel tank when the engine is at rest.

Referring to FIGS. 10 to 13, description will be made to a modified form of the air/fuel ratio control apparatus of the invention. FIG. 10 is a flow diagram illustrating of the programming of the digital computer as it is used to estimate the amount of fuel vapor produced in the fuel tank 32 when the engine is at rest. The computer program is entered at the point 302 when the ignition switch changes from its OFF position to its ON position. At the point 304 in the program, the fuel temperature TFN is read into the computer memory. At the point 306 in the program, the time interval DTMFCH [sec] during which the engine remains at rest is calculated as DTMFCH=TMFCH−TMFCH0 where TMFCH is the present timer count corresponding to the time elapsed after the engine stops and TMFCH0 is the last value for the time interval DTMFCH.

At the point 308 in the program, the average temperature TFNOFF [°C.] of fuel contained in the fuel tank 32 when the engine remains at rest is calculated or estimated as TFNOFF=(TFN+TFND)/2 where TFND is the temperature of the fuel contained in the fuel tank 32 just before the engine stops. At the point 310, the amount VPCNT0 [g] of fuel vapor produced when the engine remains at rest is calculated as VPCNT0=DTMFCH×TFNOFF×$K_2$# where $K_2$# is a constant [g/°C.sec]. At the point 312 in the program, the vapor counter count VAPCNT is calculated as VAPCNT=VAPCNT+VPCNT0. The calculated vapor counter count VAPCNT represents the total amount of fuel vapor produced since the last fuel supply. Following this, the program proceeds to the end point 314.

Figure 11:
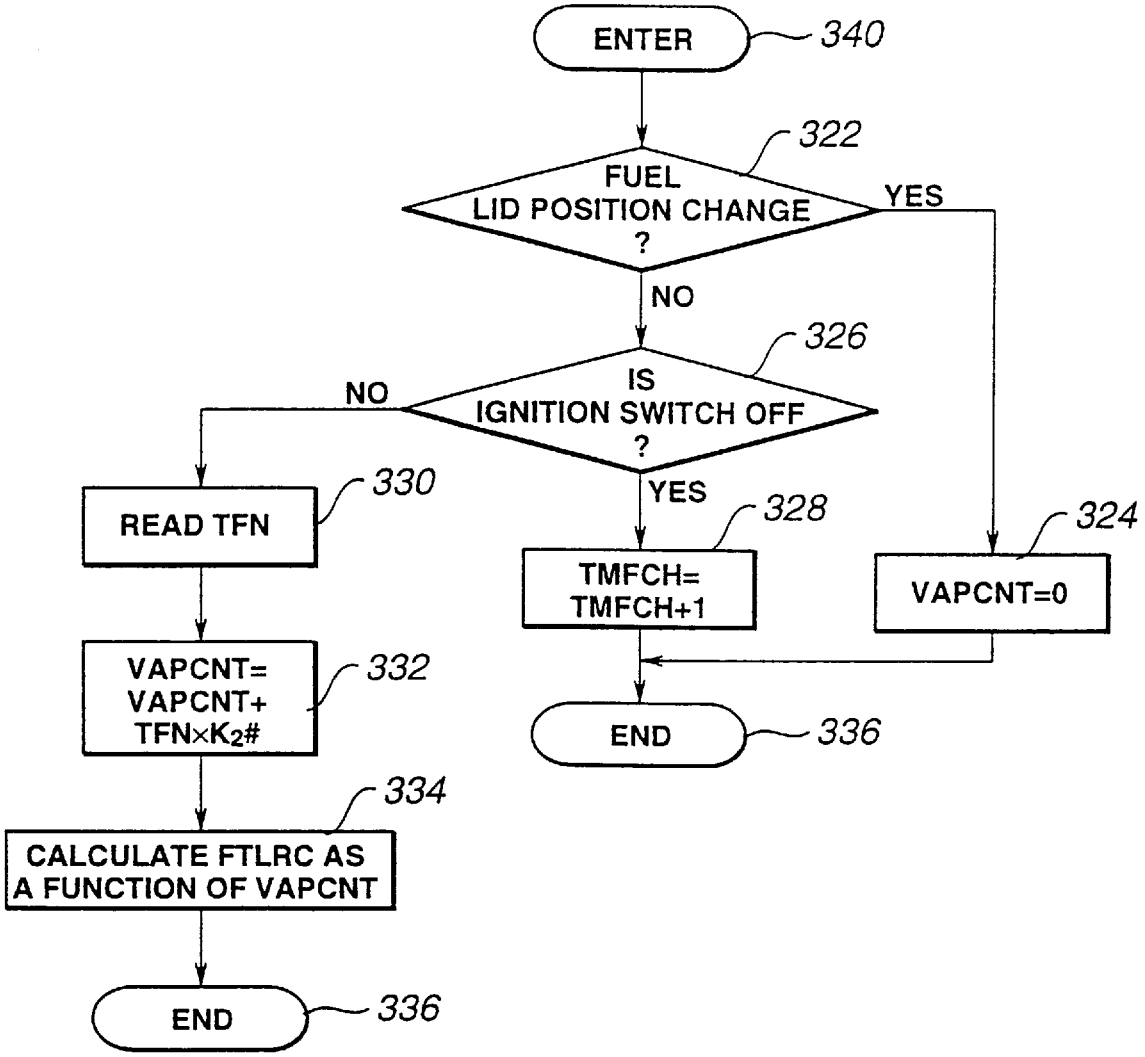
FIG. 11 is a flow diagram showing the programming of the digital computer as it is used to calculate the reference temperature value.

FIG. 11 is a flow diagram illustrating the programming of the digital computer as it is used to calculate the reference value FTLRC. The computer program is entered at the point 202 at uniform time intervals, for example, 1 second. At the point 320 in the program, a determination is made as to whether or not the fuel lid changes from its open position to its closed position. If the answer to this question is "yes", then it means that the vehicle is fed with fuel and the program proceeds to the point 324 where the vapor counter count VAPCNT is cleared to zero and then to the end point 336.

If the answer to the question inputted at the point 322 is "no", then the program proceeds to another determination step at the point 322. This determination is as to whether or not the ignition switch is at its OFF position. If the answer to this question is "yes", then the program proceeds to the point 328 where the timer count TMFCH is incremented by one step and then to the end point 336. The timer count TMFCH indicates the accumulated time elapsed after the engine stops.

Figure 12:
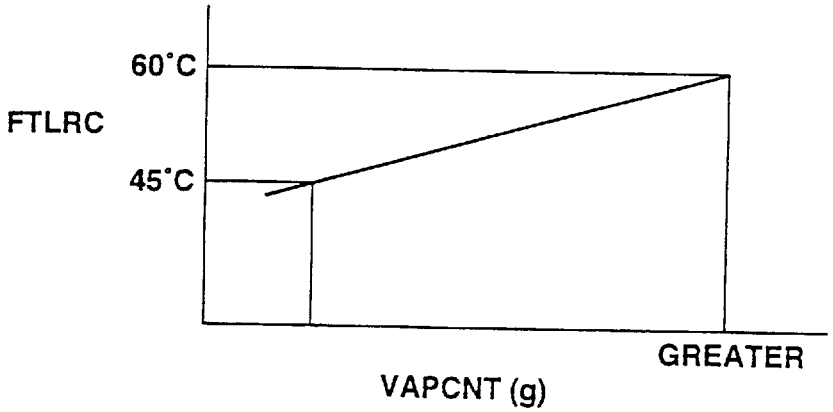
FIG. 12 is a graph showing a look-up table which defines the reference temperature value as a function of vapor counter count.

If the ignition switch is at its ON position, then the program proceeds from the point 326 to the point 330 where the fuel temperature TFN is read into the computer memory. At the point 332 in the program, the vapor counter count VAPCNT is updated as VAPCNT=VAPCNT+TFN×$K_3$# where $K_3$# is a constant [g/°C.]. The product TFN×$K_3$# represents the amount of fuel vapor produced for one second when the temperature of the fuel contained in the fuel tank 32 is TFN. At the point 334, the reference value FTLRC is calculated from a look-up table programmed into the computer. This look-up table defines the reference value FTLRC as a function of the vapor counter count VAPCNT, as shown in FIG. 12. The reference value FTLRC is in direct proportion to the vapor counter count VAPCNT.

The component of fuel evaporated in the fuel tank 32 is hydrocarbon having a small carbon number and its percentage is dependent on the kind of fuel. Assuming that the fuel contained in the fuel tank 32 remains at a high temperature, the hydrocarbon is evaporated actively just after the fuel supply. However, no fuel vapor is produced in the fuel tank 32 after all of the hydrocarbon is evaporated with the lapse of tim. It is unnecessary to inhibit the learned value updating operation after all of the hydrocarbon is evaporated even though the fuel temperature exceeds 45° C. For this reason, the reference value FTLRC can increase until 60° C. as the amount of fuel vapor produced in the fuel tank 32 decreases (or the total amount of fuel vapor produced in the fuel tank 32 increases).

Figure 13:
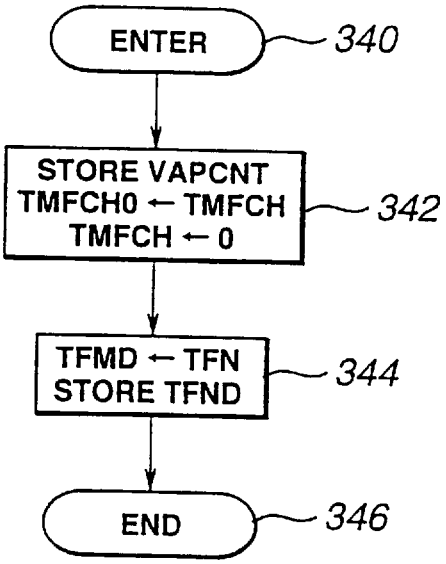
FIG. 13 is a flow diagram showing the programming of the digital computer for a process after the engine stops.

FIG. 13 is a flow diagram illustrating the programming of the digital computer for a process after the engine stops. The computer program is entered at the point 340 when the ignition switch changes from its ON position to its OFF position. At the point 243 in the program, the vapor counter count VAPCNT is stored in the memory backed up by the car battery. After the timer count TMFCH is stored as a variable TMFCH0 in the memory backed up by the car battery, the timer count TMFCH is reset. At the point 344, the fuel temperature TFN is stored as a variable TFNF in the memory backed up by the car battery. Following this, the program proceeds to the end point 346.

Figures 14A, 14B, 14C, 14D, 14E:
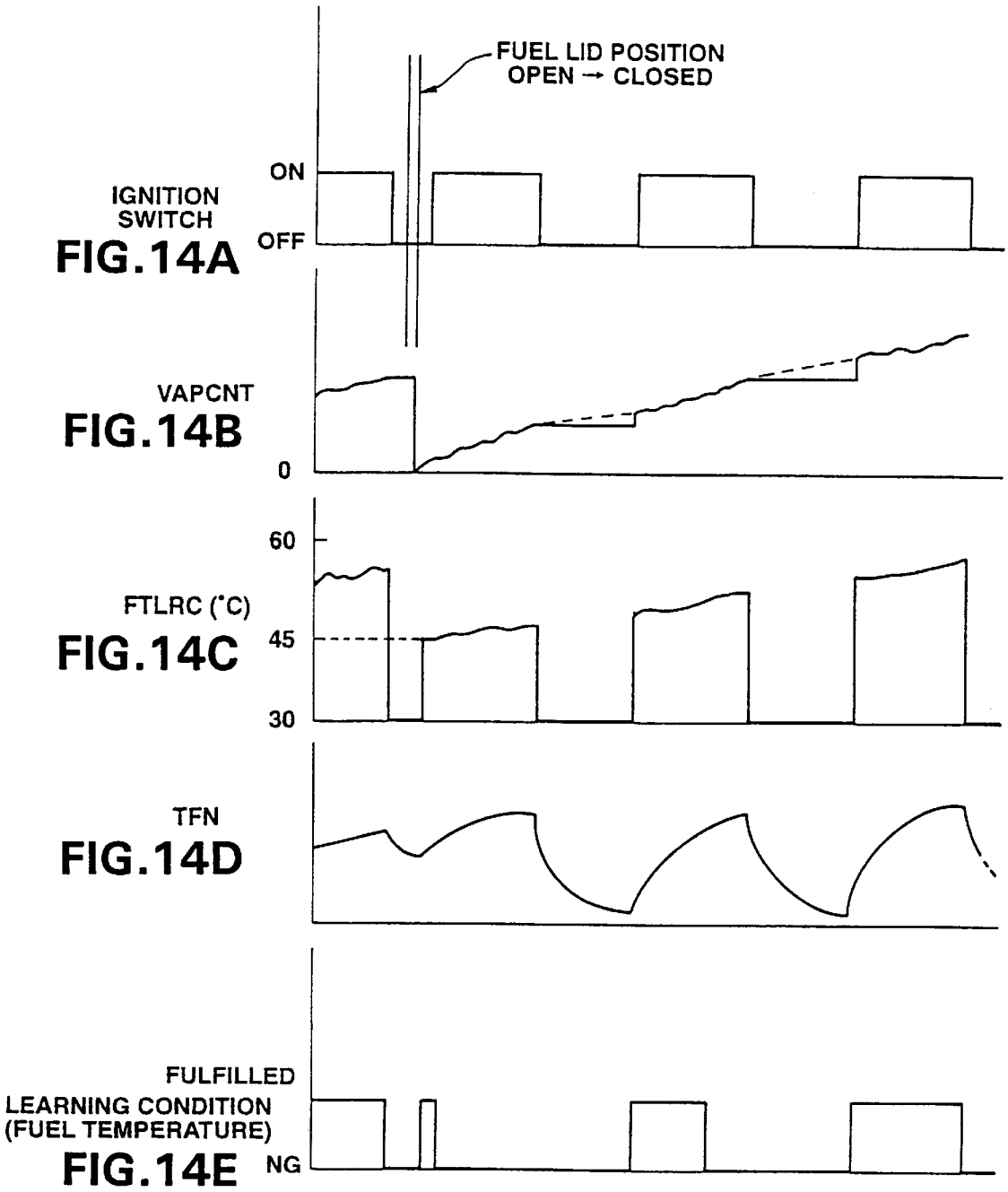
FIGS. 14A–E contain graphs used in explaining the operation of the air/fuel ratio control apparatus of the invention.

Referring to FIG. 14, the operation will be described further. At the end of fuel supply, the vapor counter count VAPCNT is cleared to zero. With the lapse of time after the fuel supply, the vapor counter count VAPCNT increases and the reference value FTLRC increases. Since the vapor counter count VAPCNT corresponds to the total amount of hydrocarbon evaporated in the fuel tank 32, the amount of hydrocarbon which can be evaporated in the fuel tank 32 decreases.

Assuming now that the temperature TFN of the fuel contained in the fuel tank 32 varies as shown in FIG. 14, the learning condition related to the fuel temperature is fulfilled in a short time just after the fuel supply, whereas it is fulfilled over the period of time during which the engine is operating when the vapor counter count VAPCNT is great. It is, therefore, possible to increase the frequency at which the air/fuel ratio is learned so as to increase the accuracy of the learned air/fuel ratio values as compared to the first embodiment.

The oxygen sensor 45 may be removed and replaced with an air/fuel ratio sensor for the same purpose. Although the amount of fuel vapor produced in the fuel tank 32 is represented in grams, it is to be noted that it may be represented in litters.

According to this embodiment of the invention, the learning operation of updating the learned air/fuel ratio value is performed when the fuel temperature is less than a reference value during air/fuel ratio feedback control. The learning operation is inhibited when the fuel temperature exceeds the reference value. This is effective to avoid errors introduced into the learned air/fuel ratio value because of the fuel vapor produced in the fuel tank and introduced into the engine without absorption in the canister and also to increase the frequency at which the learned air/fuel ratio is updated as compared to the case where the learning operation is inhibited regardless of the amount of fuel vapor produced in the fuel tank. It is preferable to increase the frequency at which the learned air/fuel ratio is updated by decreasing the reference value as the atmospheric pressure decreases. It is possible to increase the frequency at which the learned air/fuel ratio is updated by increasing the reference value as the estimated total amount of fuel vapor produced after the vehicle is fed with fuel increases.

Figure 15:
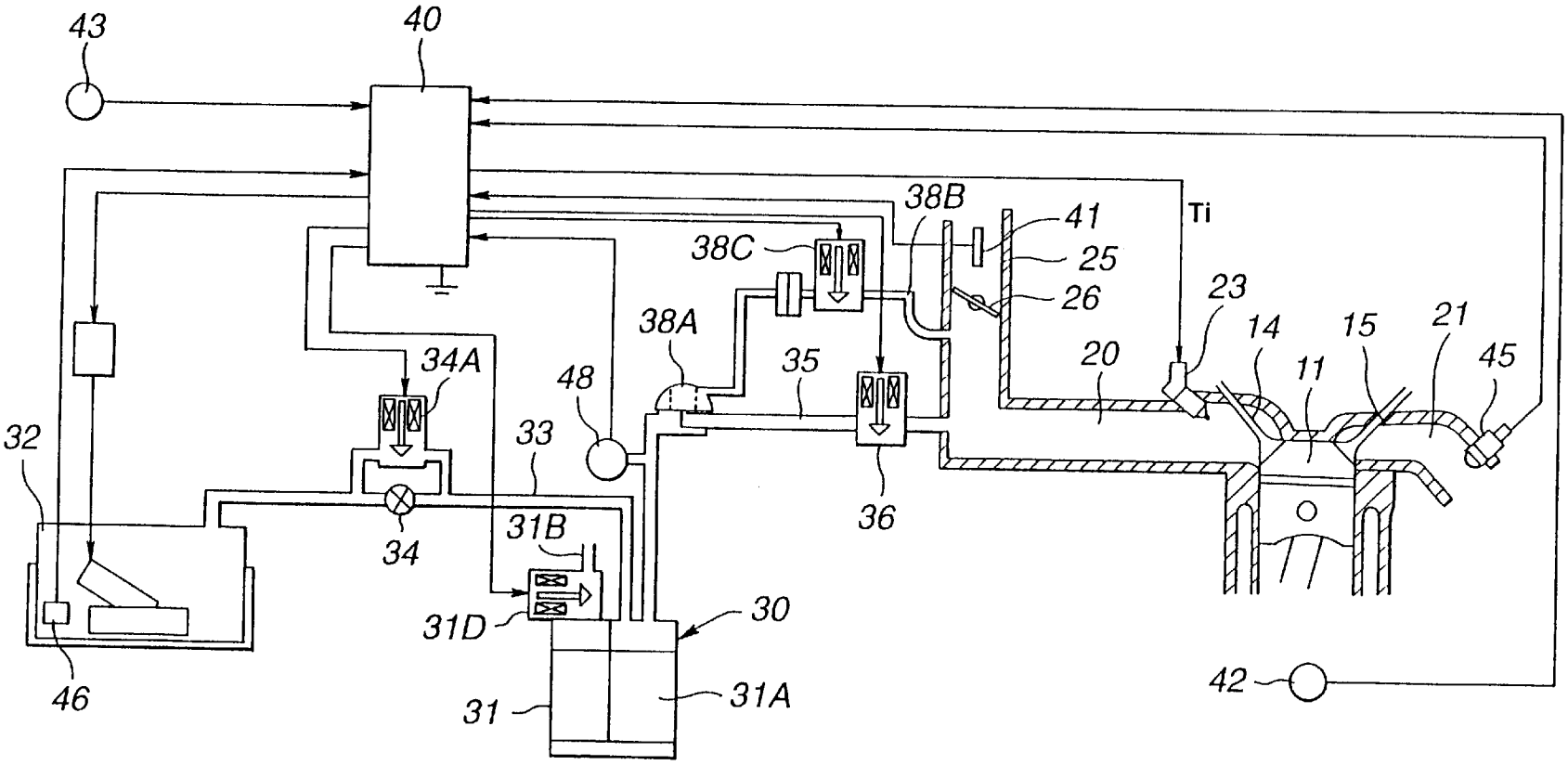
FIG. 15 is a schematic diagram showing a second embodiment of the air/fuel ratio control apparatus of the invention.

Referring to FIG. 15, there is shown a second embodiment of the air/fuel ratio control apparatus of the invention. An internal combustion engine, generally designated by the numeral 10, for an automotive vehicle includes combustion chambers or cylinders, one of which is shown at 11. A crankshaft (not shown) is supported for rotation with the engine 10 in response to reciprocation of the piston 12 within the cylinder 11. An intake manifold 20 is connected with the cylinder 11 through an intake port with which an intake valve 14 is in cooperation for regulating the entry of combustion ingredients into the cylinder from the intake manifold 20. An exhaust manifold 21 is connected with the cylinder through an exhaust port with which an exhaust valve 15 is in cooperation for regulating the exit of combustion products, exhaust gases, from the cylinder into the exhaust manifold 21. The exhaust gases are discharged to the atmosphere through an exhaust duct having a three-way catalytic converter (not shown). The intake and exhaust valves 14 and 15 are driven through a suitable linkage with the crankshaft.

A fuel injector 23 is mounted for injecting fuel into the intake manifold 20 toward the intake valve 14. The fuel injector 23 opens to inject fuel into the intake manifold 20 when it is energized by the presence of electrical signal Ti. The length of electrical pulse, that is, the pulse-width, applied to the fuel injector 23 determines the length of time the fuel injector 23 opens and, thus, determines the amount of fuel injected into the intake manifold 20. Air to the engine 10 is supplied through an air cleaner (not shown) into an induction passage 25. The amount Q of air permitted to enter the combustion chamber through the intake manifold 20 is controlled by a butterfly throttle valve 26 located within the induction passage 25. The throttle valve 26 is connected by a mechanical linkage to an accelerator pedal (not shown). The degree to which the accelerator pedal is depressed controls the degree of rotation of the throttle valve 26.

The engine 10 is associated with an evaporated fuel purging unit, generally designated by the numeral 30, which includes a canister 31 employing an absorbent 31A, such for example as activated charcoal, for accumulating or absorbing evaporated fuel introduced thereinto from a fuel tank 32. For this purpose, the canister 31 has an inlet port connected through an evaporated fuel passage 33 to the upper space of the fuel tank 32. The evaporated fuel passage 33 has a check valve 34 which permits the evaporated fuel to flow from the fuel tank 32 to the canister 31 when the evaporated fuel pressure exceeds a predetermined value while preventing back-flow. The check valve 34 is bypassed by a passage having a normally closed bypass valve 34A provided therein. The canister 31 also has an outlet port connected through a purge passage 35 to the induction passage 25 at a position downstream of the throttle valve 26. The canister 31 has a purge or purging air inlet 31B connected to the atmosphere and it has a normally open drain cut valve 31D. A flow control valve 36, which is provided in the purge passage 35, operates on a command from a control unit 40 to open and close the purge passage 35. The purge passage 35 also has a diaphragm actuator 38A which operates in response to a negative pressure introduced thereinto through a passage 38B opening into the induction passage 25 at a position downstream of the throttle valve 26. The passage 38B has a purge cut valve 38C which operates on command from the control unit 40. When the purging conditions are fulfilled, the control unit 40 produces a command to open the purge cut valve 38C so as to introduce a negative pressure to which the diaphragm actuator 38A responds by opening the purge passage 35. When the flow control valve 36 opens, fresh air is introduced through the purge air inlet 31B to purge the fuel vapor absorbed by the absorbent 31A. The purged fuel vapor is introduced, along with the air, through the purge passage 35 to the induction passage 25.

The amount of fuel metered to the engine, this being determined by the width of the electrical pulse Ti applied to the fuel injector 23 is repetitively determined from calculations performed by the control unit 40, these calculations being based upon various conditions of the engine that are sensed during its operation. The flow cross sectional area of the purge passage 35, this being determined by the duty (DUTY) of the control signal applied to the flow control valve 36 is repetitively determined from calculations performed by the control unit 40, these calculations being based upon various conditions of the engine that are sensed during its operation. These conditions include intake air flow rate Qa, engine speed Ne, engine coolant temperature Tw, oxygen content and fuel temperature. Thus, an airflow meter 41, a crankshaft position sensor 42, an engine coolant temperature sensor 43, an oxygen sensor 45 and a fuel temperature sensor 46 are connected to the control unit 40. The airflow meter 41 is provided to detect the amount Qa of air permit to enter the induction passage 25 and it produces a signal indicative of the detected intake air flow rate Q. The crankshaft position sensor 42 produces a series of crankshaft position electrical pulses, each corresponding to one degree of rotation of the engine crankshaft, of a repetition rate directly proportional to engine speed Ne and a reference electrical pulse Ref at a predetermined number of degrees (for example, 180° for four-cylinder engines and 120° for six-cylinder engines). The engine coolant temperature sensor 43 is provided to sense the temperature Tw of the engine coolant and it produces a signal indicative of the sensed engine coolant temperature. The oxygen sensor 45 is located in the engine exhaust duct to provide a feedback signal used to ensure that the fuel supplied to the engine is correct to maintain a desired optimum air/fuel ratio. The fuel temperature sensor 46 is provided to sense the temperature TFN of fuel contained in the fuel tank 32 and it produces a signal indicative of the sensed fuel temperature. A pressure sensor 48 is provided for producing a signal indicative of the pressure in the purge passage 35. This signal is fed to. the control unit 40 for checking leakage in the fuel purging unit 30.

The control unit 40 may employ a digital computer which includes a central processing unit (CPU), a random access memory (RAM), a read only memory (ROM), and an input/output control circuit (I/O). The central processing unit communicates with the rest of the computer via data bus. The input/output control circuit includes a counter which counts the reference pulses fed from the crankshaft position sensor 42 and converts its count into an engine speed indication digital signal for application to the central processing unit. The input/output control circuit also includes an analog-to-digital converter which receives analog signals from the flow meter 41 and the other sensors and converts them into digital form for application to the central processing unit. The read only memory contains the program for operating the central processing unit and further contains appropriate data in look-up tables used in calculating appropriate values for fuel delivery requirements and purge rates. Control words specifying desired fuel delivery requirements and purge rates are periodically transferred by the central processing unit to the fuel-injection and purge control circuits included in the input/output control circuit. The fuel injection control circuit converts the received control word into a fuel injection pulse signal for application to the fuel injector 23. The fuel injector 23 opens for a time period determined by the width of the fuel injection control pulse signal. The purge control circuit converts the received control word into a drive pulse signal for application to the flow control valve 36. The flow control valve 36 opens and closes at a duty determined by the drive pulse signal.

Figure 16:
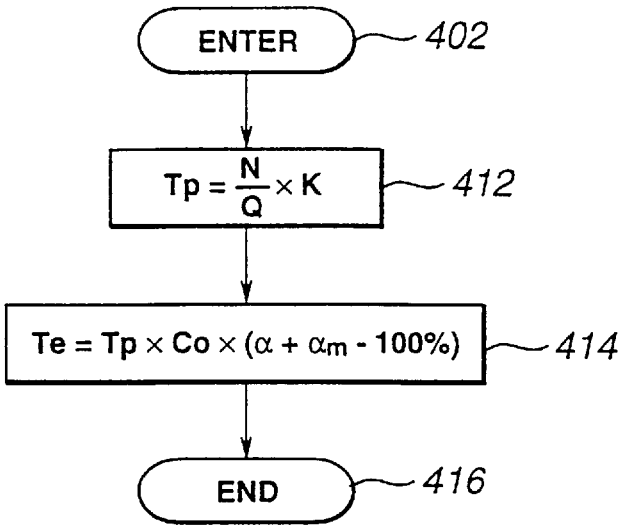
FIG. 16 is a flow diagram showing the programming of the digital computer as it is used to calculate an effective value for fuel-injection pulse-width.

FIG. 16 is a flow diagram illustrating the programming of the digital computer as it is used to calculate the effective value Te for fuel-injection pulse-width. The computer program is entered at the point 402 at uniform time intervals, for example, 10 milliseconds. At the point 404 in the program, a basic value Tp for fuel delivery requirement is calculated as $Tp=K\cdot Q/N$ where K is a constant, Q is the intake air flow sensed by the airflow meter 47, and N is the engine speed derived from the signal fed from the crankshaft position sensor 42. At the point 406, the effective value Te is calculated as $Te=Tp\times Co\times(\alpha+\alpha m-100\%)$ where Co is various correction factors, $\alpha$ is the air/fuel ratio feedback correction factor [%] and $\alpha m$ is the learned air/fuel ratio value [%].

Figure 17:
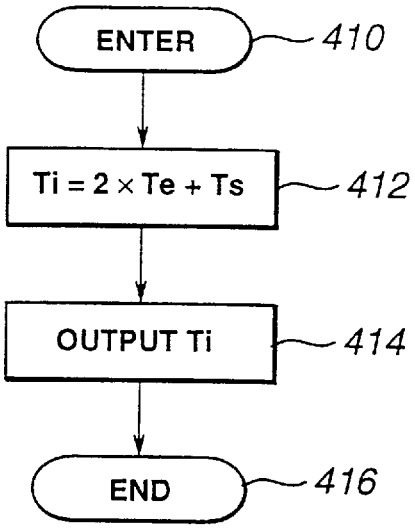
FIG. 17 is a flow diagram showing the programming of the digital computer as it is used to calculate a desired value for fuel-injection pulse-width.

FIG. 17 is a flow diagram illustrating the programming of the digital computer as it is used to calculate a desired value Ti for fuel delivery requirement in the form of fuel-injection pulse-width. The computer program is entered at the point 410 in synchronism with the reference signal Ref. At the point 412 in the program, a target value Ti for fuelinjection pulse-width is calculated as $Ti=2\times Te+Ts$ where Ts is an ineffective pulse width corresponding to the car battery voltage. At the point 414, the calculated target value Ti is transferred to the input/output control circuit which converts it into a corresponding signal having a pulse width Ti calculated by the computer. Following this, the program proceeds to the end point 416. Assuming now that the sequence or order of firing of a four-cylinder engine is as follows: Cylinders #1, #3, #4 and #2 and fuel is supplied to the cylinder #1 in an amount corresponding to the calculated target value Ti in response to the present reference pulse Ref, fuel is supplied to the cylinder #3 in response to the next reference pulse Ref, fuel is supplied to the cylinder #4 in response to the next but one reference pulse Ref, and fuel is supplied to the cylinder #2 in response to the next but two reference pulse Ref.

Figure 18:
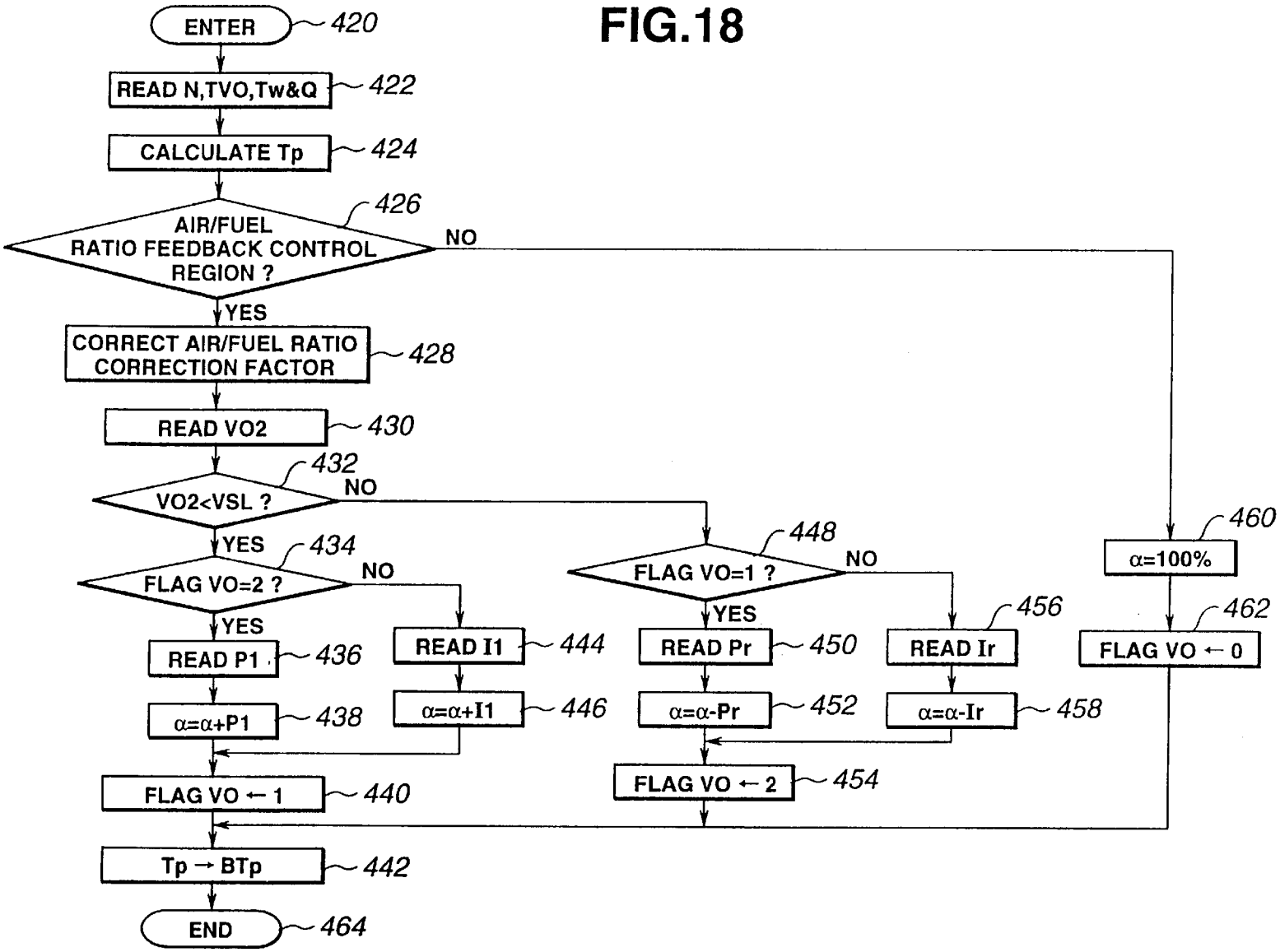
FIG. 18 is a flow diagram showing the programming of the digital computer as it is used for air/fuel ratio feedback control.

FIG. 18 is a flow diagram illustrating the programming of the digital computer as it is used for air/fuel ratio feedback control. The computer program is entered at the point 420 at uniform time intervals. At the point 422 in the program, the engine speed N,. the throttle valve position TV0, the engine coolant temperature Tw and the intake air flow rate Q are read into the computer memory. At the point 424, a basic value Tp for fuel delivery requirement in the form of fuel-injection pulse-width is calculated based on these read values. At the point 426 in the program, a determination is made as to whether or not the engine operating conditions are in a predetermined region where an air/fuel ratio feedback control is required. If the answer to this question is "yes", then the program proceeds to the point 428, where the air/fuel ratio correction factor is corrected when the purge cut valve 38C is moving between its open and closed position.

At the point 430 in the program, the output $VO_2$ of the oxygen sensor 45 is read into the computer memory. At the point 432, a determination is made as to whether or not the read oxygen sensor output $VO_2$ is less than a predetermined value VSL. If the answer to this question is "yes", then it means that the air/fuel ratio of the exhaust gases is lean and the program proceeds to another determination step at the point 434. This determination is as to whether or not flag VO=2. If the answer to this question is "yes", then it means that the exhaust gas air/fuel ratio changes from a rich value to a lean value and the program proceeds to the point 436 where a proportional term Pl is calculated from a look-up table programmed into the computer. This look-up table defines the proportional term Pl as a function of engine speed N and basic fuel-injection pulse-width value Tp. At the point 438 in the program, the feedback correction factor $\alpha$ is corrected by adding the calculated proportional term Pl to the feedback correction factor $\alpha$.

If the answer to the question inputted at the point 434 is "no", then the program proceeds to the point 444 where an integral term Il is read. At the point 446, the feedback correction factor $\alpha$ is corrected by adding the read integral term Il to the feedback correction factor $\alpha$. At the point 440 in the program, the lean/rich determination result is retained in the flag VO. At the point 442, the calculated basic fuel-injection pulse-width value Tp is retained in BTp. Following this the program proceeds to the end point 464.

If $VO_2 \geqq VSL$, then it means that the exhaust gas air/fuel ratio is rich and the program proceeds from the point 432 to a determination step at the point 448. This determination is as to whether or not flag VO=1. If the answer to this question is "yes", then it means that the exhaust gas air/fuel ratio changes from a lean value to a rich value and the program proceeds to the point 450 where a proportional term Pr is calculated from a look-up table programmed into the computer. This look-up table defines the proportional term Pr as a function of engine speed N and basic fuel-injection pulse-width value Tp. At the point 452 in the program, the feedback correction factor a is corrected by subtracting the calculated proportional term Pr from the feedback correction factor $\alpha$.

If the answer to the question inputted at the point 448 is "no", then the program proceeds to the point 456 where an integral term Ir is read. At the point 458, the feedback correction factor α is corrected by subtracting the read integral term Ir from the feedback correction factor α. At the point 454 in the program, the lean/rich determination result is retained in the flag VO. Following this, the program proceeds to the point 442. If the engine operating conditions are out of the predetermined air/fuel ratio feedback control region, then the program proceeds to the point 460 where the feedback correction factor α is set at 100%. At the point 462 in the program, the flag VO is cleared to 0. Following this, the program proceeds to the point 442.

Figure 19A:
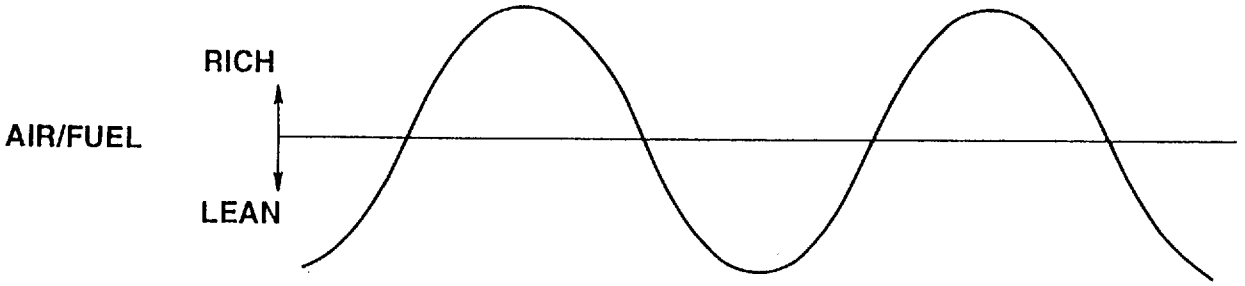
FIGS. 19A, 19B and 19C are graphs used in explaining the air/fuel ratio feedback control.
Figure 19B:
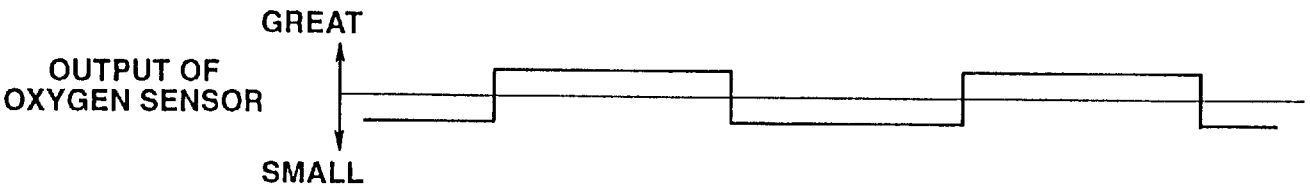
Figure 19C:
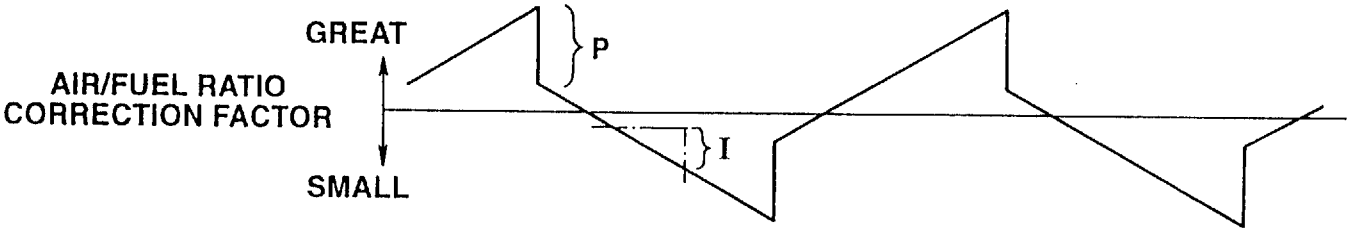

Referring to FIGS. 19A, 19B and 19C, the air/fuel ratio feedback control made according to the program of FIG. 18 will be described. when the air/fuel ratio shifts onto the rich side and the output of the oxygen sensor 45 exceeds the slice level corresponding to stoichiometry, the air/fuel ratio control is made in a direction leaning the air/fuel ratio by decreasing the feedback correction factor α by the proportional term Pr in a stepped form and then decreasing gradually at a gradient equal to the integral term Ir. When the air/fuel ratio shifts onto the lean side and the output of the oxygen sensor 45 decreases below the slice level, the air/fuel ratio control is made in a direction enriching the air/fuel ratio by increasing the feedback correction factor α by the proportional term Pl in a stepped form and then increasing gradually at a gradient equal to the integral term Il. These operations are repeated to hold the actual air/fuel ratio around stoichiometry.

Figure 20:
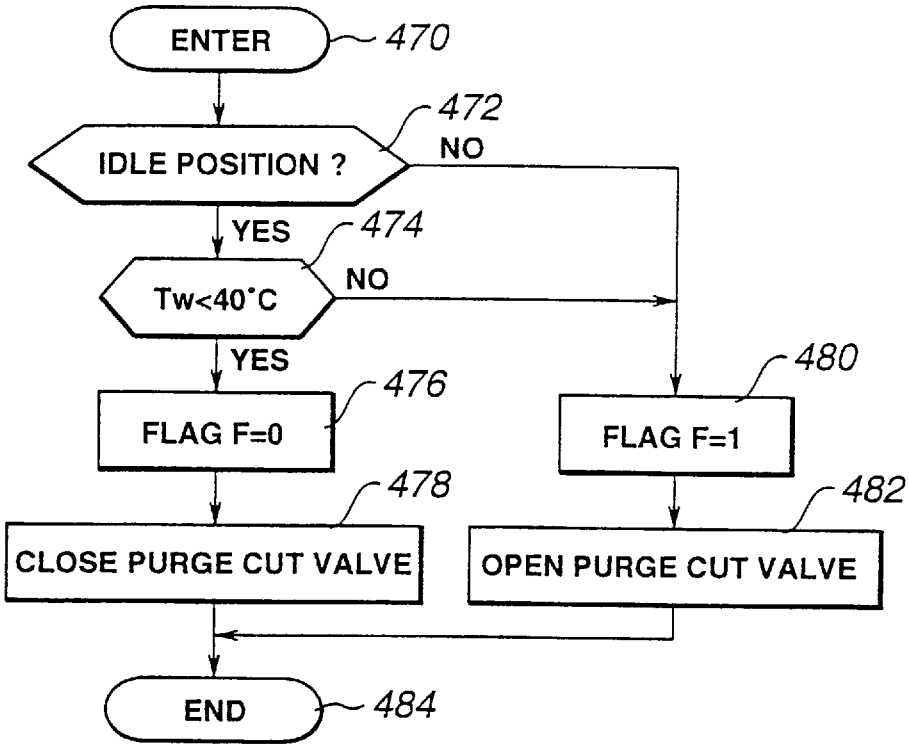
FIG. 20 is a flow diagram showing the programming of the digital computer as it is used to control the purge cut valve.

FIG. 20 is a flow diagram illustrating the programming of the digital computer as it is used to control the purge cut valve 38C. The computer program is entered at the point 470 at uniform time intervals. At the point 472 in the program, a determination is made as to whether or not the throttle valve 26 is at its idle position. This determination is made based on the signal fed from the idle switch associated with the throttle valve 26. If the answer to this question is "yes", then the program proceeds to the point 474. Otherwise, the program proceeds to the point 380. At the point 474 in the program, a determination is made as to whether or not the engine coolant temperature Tw is lower than a predetermined value, for example, 40° C. This determination is made based on the signal fed from the engine coolant temperature sensor 43. If the answer to this question is "yes", then it means that a warmed engine is idling and the program proceeds to the point 476 where a flag F is cleared to 0 and to the point 478 where a command is produced to close the purge cut valve 38C. Otherwise, the program proceeds to the point 480 where the flag F is set at 1 and to the point 482 where a command is produced to open the purge cut valve 38C. Following this, the program proceeds to the end point 484.

Figure 21:
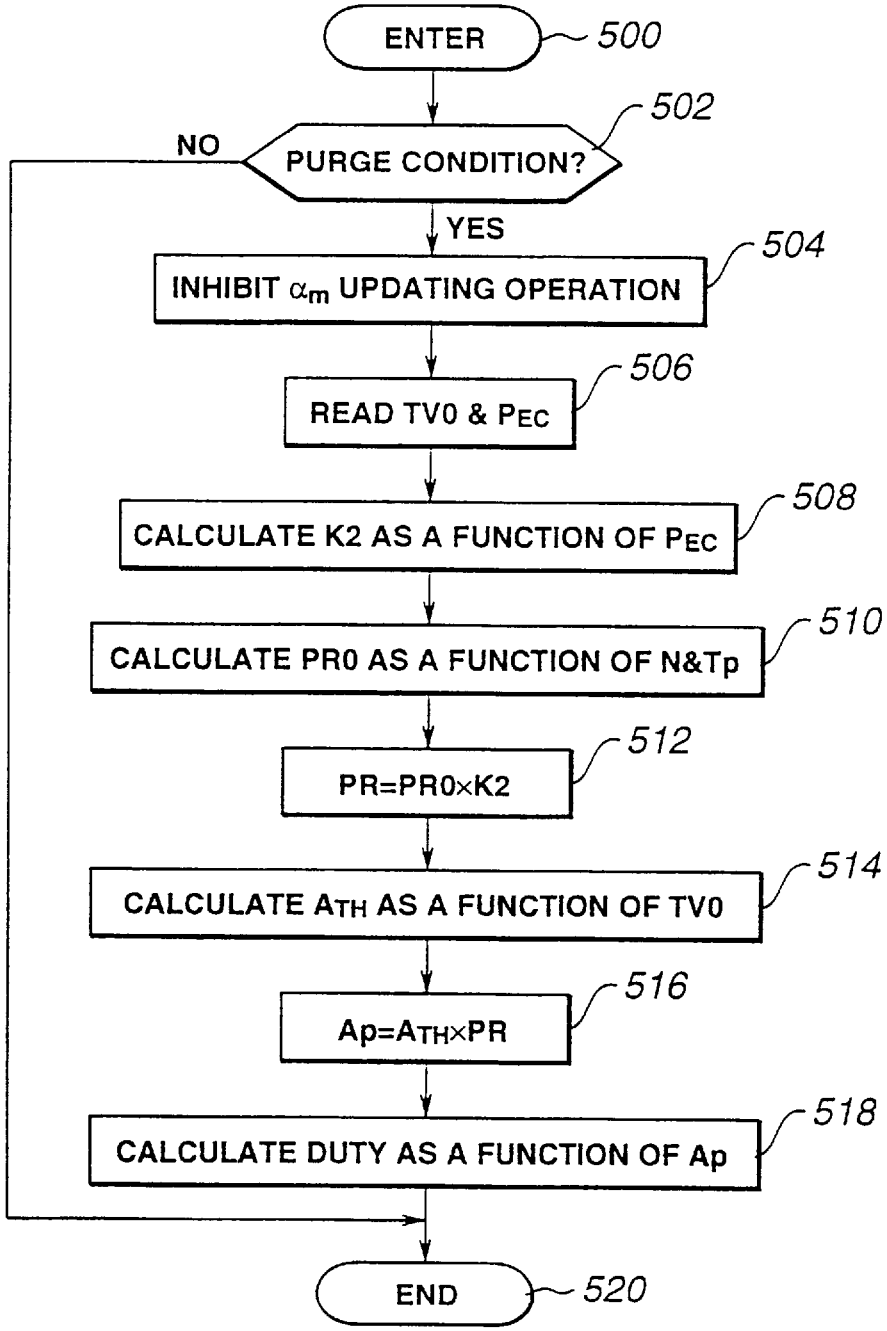
FIG. 21 is a flow diagram showing the programming of the digital computer as it is used to calculate the duty of the purge control valve.

FIG. 21 is a flow diagram illustrating the programming of the digital computer as it is used to calculate an ON duty of the signal applied to the purge control valve 36. The computer program is entered at the point 500 at uniform time intervals, for example, 1 second. At the point 502 in the program, a determination is made as to whether or not the purge conditions are fulfilled. The purge conditions are fulfilled, for example, when the engine has been warmed and the engine is operating at a low load under the air/fuel ratio feedback control. If the answer to this question is "yes", then the program proceeds to the point 504. Otherwise, the program proceeds to the end point 520. At the point 504 in the program, a command is produced to prevent the learned air/fuel ratio value am from being updated.

Figure 22:
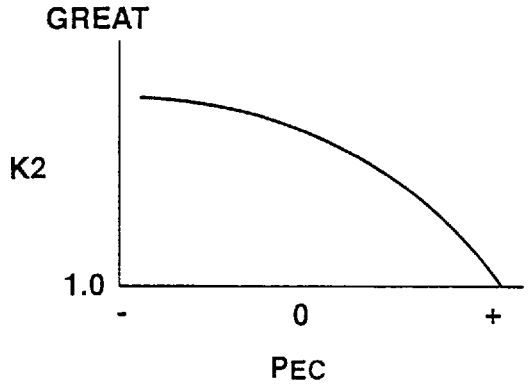
FIG. 22 is a graph showing a look-up table which defines the purge rate correction factor as a function of parameter.

At the point 506 in the program, the throttle valve position TVO is read, along with a parameter $P_{EC}$, into the computer memory. The parameter $P_{EC}$ represents the purge gas concentration to be described later. At the point 508, a purge rate correction factor K2 is calculated from a look-up table programmed into the computer. This look-up table defines the purge rate correction factor K2 as a function of parameter $P_{EC}$ as shown in FIG. 22. At the point 510, a basic purge rate value PRO is calculated from a look-up table programmed into the computer. This look-up table defines the basic purge rate value PRO as a function of engine speed N and basic fuel-injection pulse-width value Tp. At the point 512, the purge rate PR is calculated as PR=PRO×K2. That is, the purge rate correction factor K2 is used to increase the basic purge rate value PRO. Although the basic purge rate value PRO is normally a constant value calculated as PRO [%]=Pv/Qv×100 where Pv is the volumetric purge flow rate and Qv is the volumetric intake flow rate, it is preferable to increase the purge rate gradually from a small initial value just after engine starting where the canister 31 is filled with fuel vapor and the purge gases has a great concentration. As shown in FIG. 22, the purge rate correction factor K2 decreases as the parameter $P_{EC}$ increases. The reason for this is that the fuel can be purged at a great flow rate to empty the canister 31 quickly since the influence of increased purge gas flow rate on the air/fuel ratio during the air/fuel ratio feedback control is small when the purge gas concentration is small.

Figure 23:
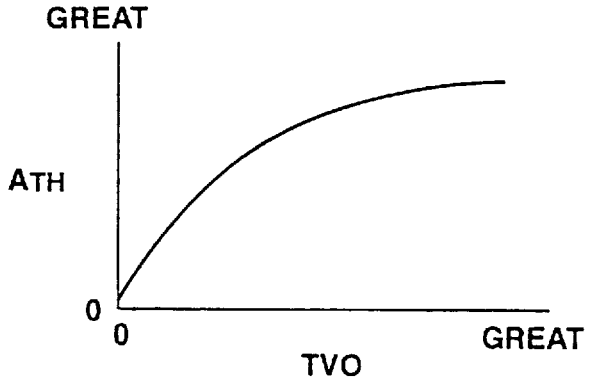
FIG. 23 is a graph showing a look-up table which defines the throttle valve flow cross sectional area as a function of throttle valve position.
Figure 24:
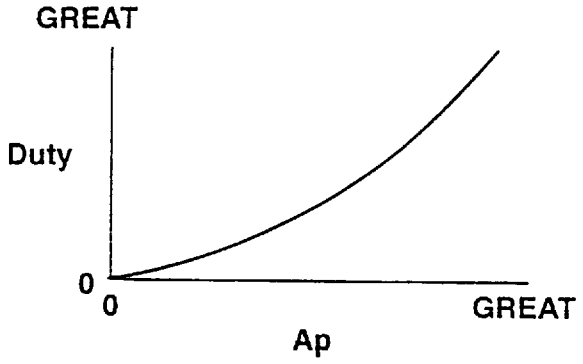
FIG. 24 is a graph showing a look-up table which defines the duty as a function of target flow cross sectional area.

At the point 514 in the program, the flow cross sectional area $A_{TH}$ of the throttle valve is calculated from a look-up table programmed into the computer. This look-up table defines the throttle valve flow cross sectional area $A_{TH}$ as a function of throttle valve position TVO, as shown in FIG. 23. At the point 516, a target flow cross sectional area $A_P$ of the purge control valve is calculated as $A_P=A_{TH}\times PR$. At the point 518, the ON duty (Duty) is calculated from a look-up table programmed into the computer. This look-up table defines the ON duty (Duty) as a function of the target flow cross sectional area $A_P$ as shown in FIG. 24. Following this, the program proceeds to the end point 520.

Figure 25:
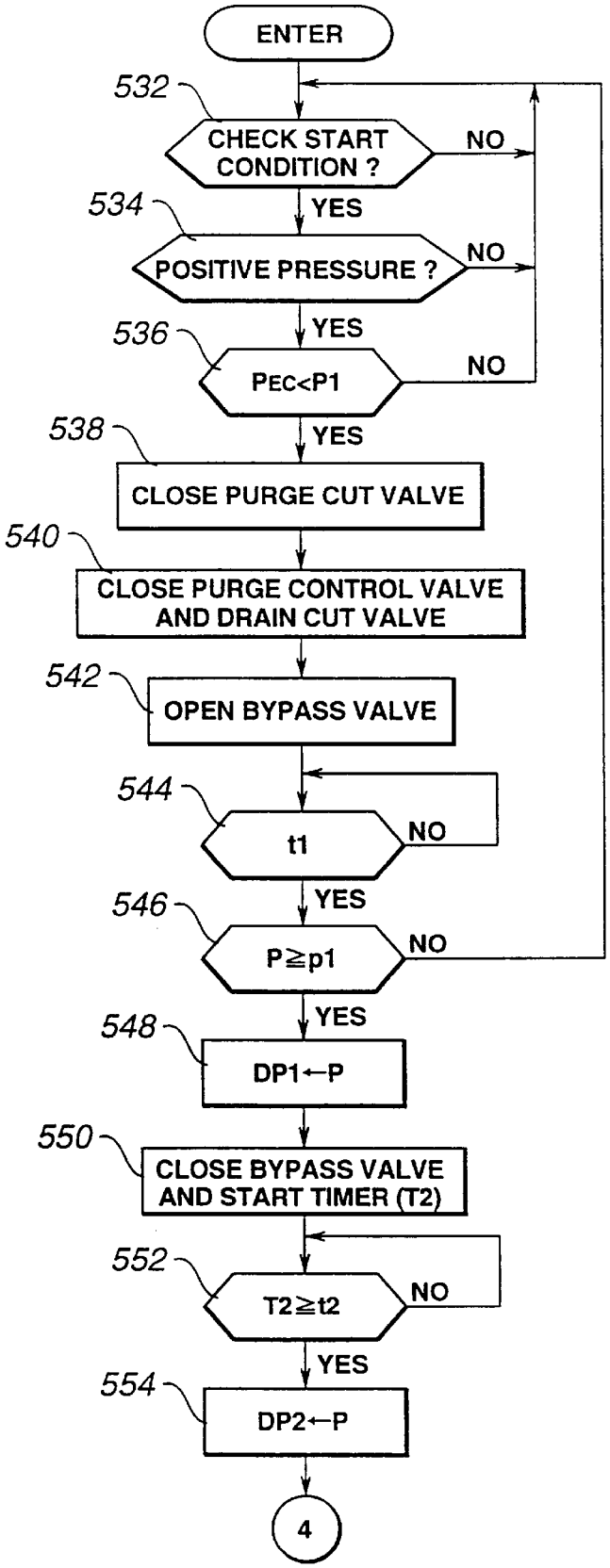
FIGS. 25 and 26 are flow diagrams showing the programming of the digital computer as it is used to check leakage in the purge control unit.
Figure 26:
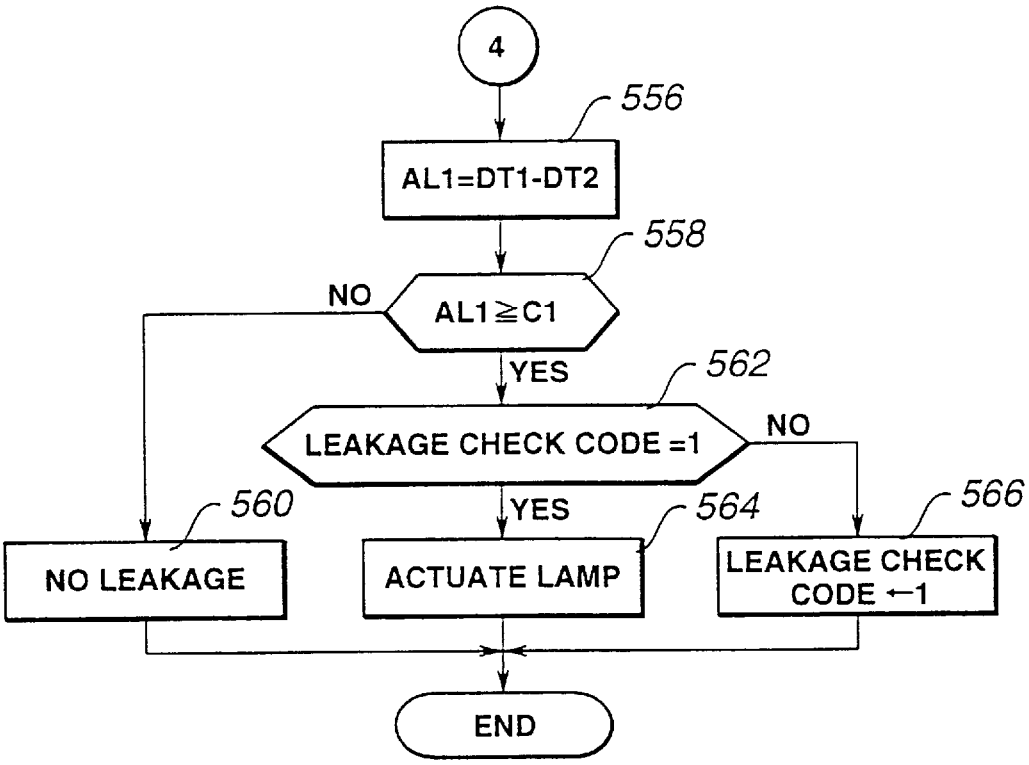

FIGS. 25 and 26 are flow diagrams illustrating the programming of the digital computer as it is used to check leakage in the purge control unit 30. This leakage check is made with the use of the fuel vapor pressure sensed by the pressure sensor 48. The computer program is entered at the point 530. At the point 532 in the program, a determination is made as to whether or not the check start conditions are fulfilled. The check start conditions are fulfilled, for example, when the pressure sensor 48, the drain cut valve 31D and the bypass valve 34A are normal. If the answer to this question is "yes", then the program proceeds to the point 534. Otherwise, the program is returned to the point 532. At the point 534, a determination is made as to whether or not fuel vapor is produced in the fuel tank 32 to provide a positive pressure required for the leakage checking. If the answer to this question is "yes", then the program proceeds to the point 536. Otherwise, the program is returned to the point 532. At the point 536, a determination is made as to whether or not the purge gas concentration parameter $P_{EC}$ is less than a predetermined value P1. If the answer to this question is "yes", then the program proceeds to the point 538. Otherwise, the program is returned to the point 532. This is repeated, that is, the fuel purging operation continues until the parameter $P_{EC}$ decreases below the predetermined value P1.

At the point 538 in the program, a command is produced to close the purge cut valve 38C. At the point 540, commands are produced to close the purge control valve 36 and close the drain cut valve 31D. Thereafter, at the point 542, a command is produced to open the bypass valve 34A. At the point 544 in the program, a determination is made as to whether or not a predetermined time t1, for example, several seconds, have been elapsed after the bypass valve 34A opens. If the answer to this question is "yes", then the program proceeds to the point 546. Otherwise, the program is returned to the point 544. At the point 546, a determination is made as to whether or not the pressure P sensed by the pressure sensor 48 is equal to or greater than a predetermined value p1. If the answer to this question is "yes", then it means that the no leakage occurs on the side of the fuel tank 32 and the program proceeds to the point 548 where the pressure P is shifted to DP1. Otherwise, the program is returned to the point 532.

At the point 550 in the program, commands are produced to close the bypass valve 34A and start the timer. At the point 552, a determination is made as to whether or not the count T2 of the timer is equal to or greater than a predetermined value t2, for example, six seconds. If the answer to this question is "yes", then the program proceeds to the point 554 where the pressure P is shifted to DP2. Otherwise, the program is returned to the point 552.

At the point 556 in the program, a leakage parameter AL1 [mmHg] is calculated as AL1=DT1−DT2. At the point 558, a determination is made as to whether or not the leakage parameter AL1 is equal to or greater than a predetermined value c1. If the answer to this question is "yes", then the program proceeds to the point 562. Otherwise, the program proceeds to the point 560 where a command is produced to indicate no leakage. At the point 562, a determination is made as to whether or not the leakage checking code has been set at 1. If the answer to this question is "yes", then it means that the leakage was checked before and the program proceeds to the point 564 where a command is produced to actuate an alarm lamp. Otherwise, the program proceeds to the point 566 where the leakage checking code is set at 1. Following this, the program proceeds to the end point 568 where the program is returned to another program used for purge control.

Figure 27:
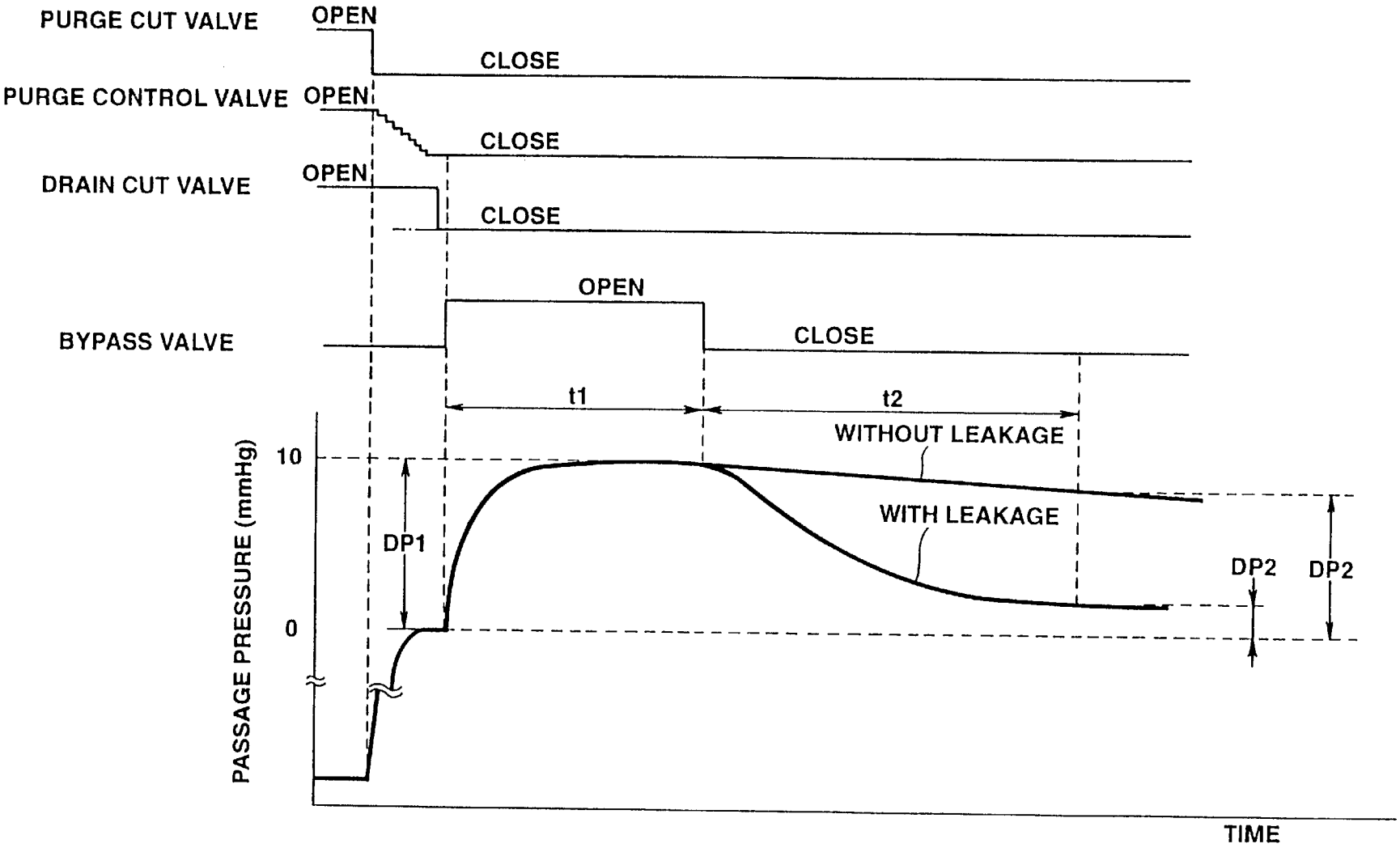
FIG. 27 is a graph used in explaining the leakage checking operation.

As the fuel temperature increases after the engine starts, fuel vapor is produced to increase the pressure in the fuel tank 32. Since the check valve 34 is selected to maintain the fuel tank 32 at a pressure of about 10 mmHg, a positive pressure required for leakage check will be retained in the fuel tank 32 if no leakage exists on the side of the fuel tank 32. The bypass valve 34A opens, with the purge cut valve 38C and drain cut valve 31D held closed, to introduce the positive pressure into the canister 31. When the bypass valve 34A is closed after a certain time, the pressure in the passage between the bypass valve 34A and the purge cut valve 38C will decreases gradually with no leakage, as shown in FIG. 27. If leakage exists in any position, the pressure will decreases rapidly. It is,. therefore, possible to check leakage based on the sensed pressure a predetermined time t2 after the bypass valve 34A closes.

Figure 28:
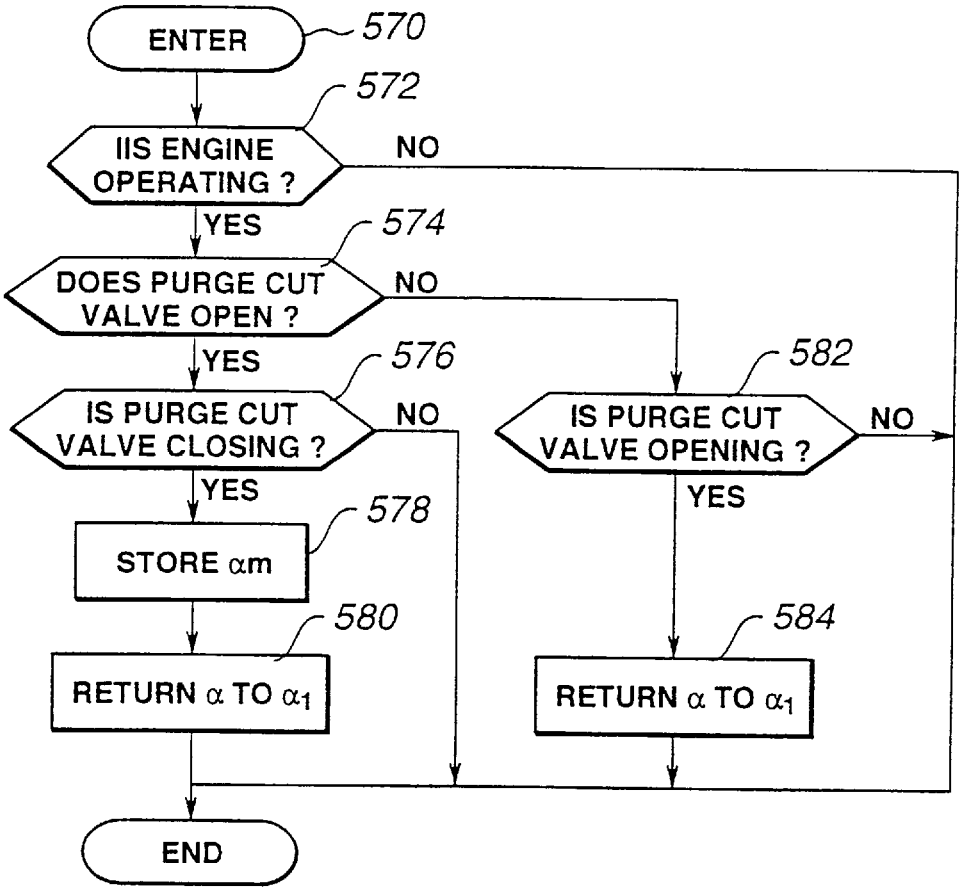
FIG. 28 is a flow diagram showing the programming of the digital computer as it is used to control the air/fuel ratio when the purge cut valve is moving between from its open and closed positions.

FIG. 28 is a flow diagram illustrating the programming of the digital computer as it is used to control the air/fuel ratio when the purge cut valve 38C is moving between its open and closed positions. The computer program is entered at the point 570 which corresponds to the point 428 of FIG. 18. At the point 572 in the program, a determination is made as to whether or not the engine is operating. If the answer to this question is "yes", then the program proceeds to the point 574. Otherwise, the program proceeds to the end point 586 which corresponds to the point 430 of FIG. 18. At the point 574, a determination is made as to whether or not the purge cut valve 38C opens. If the answer to this question is "yes", then the program. proceeds to the point 576. Otherwise, the program proceeds to the point 582. At the point 576, a determination is made as to whether or not the purge cut valve 38C is moving from its open position toward its closed position. If the answer to this question is "yes", then the program proceeds to the point 578. Otherwise, the program proceeds to the end point 586. At the point 578, the value αm stored in the memory is updated by the feedback correction factor α calculated before the purge cut valve 38C moves toward its closed position. Thereafter, at the point 580, the feedback correction factor α is set at its initial value α1. Following this, the program proceeds to the end point 586.

At the point 582 in the program, a determination is made as to whether or not the purge cut valve 38C is moving from its closed position toward its open position. If the answer to this question is "yes", then the program proceeds to the point 584. Otherwise, the program proceeds to the end point 586. At the point 584, the feedback correction factor α is set at the value αm stored in the memory. Following this, the program proceeds to the end point 586.

Figure 29:
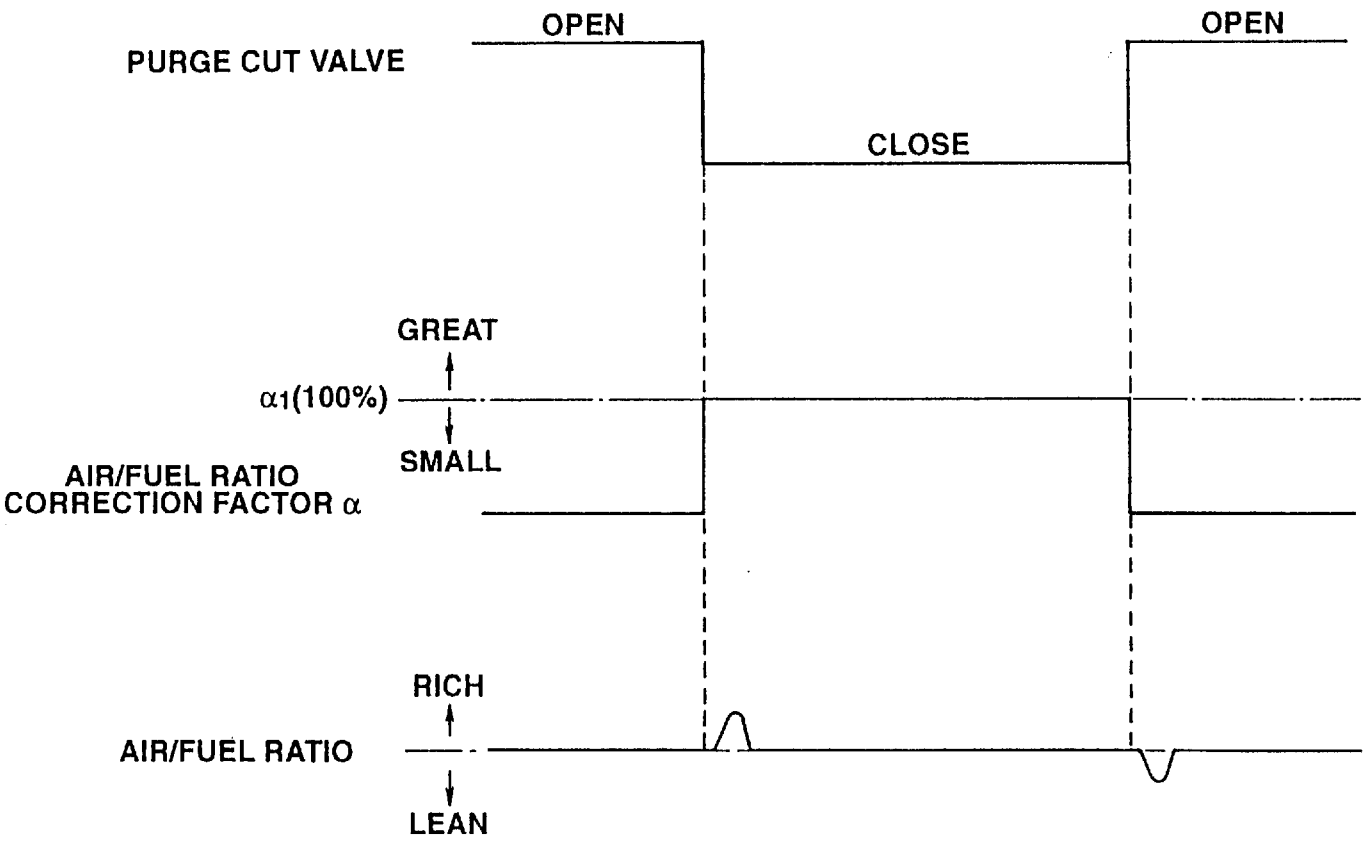
FIG. 29 contains graphs used in explaining the air/fuel ratio control operation.

As shown in FIG. 29, the feedback correction factor α is much smaller than the initial value α1 so that the fuel-injection pulse-width Te is corrected to a value greater than the basic fuel-injection pulse-width Tp when the purge cut valve 38C is open to permit introduction of fuel vapor from the purge passage 35 to the induction passage 25. As soon as the purge cut valve 38C closes to interrupt the communication between the purge passage 35 to the induction passage 25, the feedback correction factor a is returned to its initial value α1. This is effective to prevent the air/fuel ratio from being enriched temporarily after the purge cut valve 38C closes.

Figure 30:
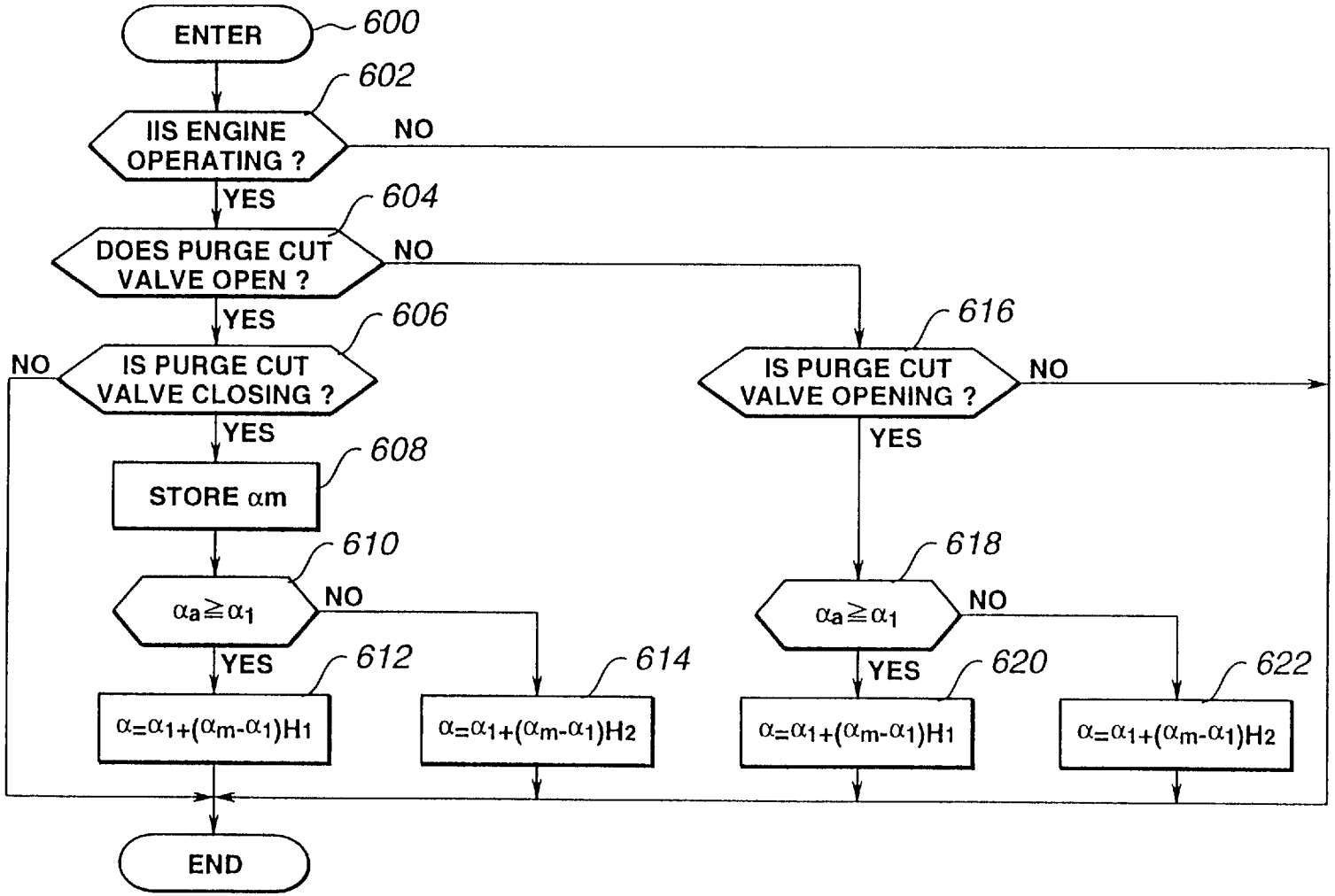
FIG. 30 is a flow diagram showing the programming of the digital computer as it is used to calculate a feedback correction factor.

FIG. 30 is a flow diagram illustrating a modified form of the programming of the digital computer as it is used to calculate a feedback correction factor α. The computer program is entered at the point 600 which corresponds to the point 428 of FIG. 18. At the point 602. in the program, a determination is made as to whether or not the purge cut valve 38C opens. If the answer to this question is "yes", then the program proceeds to another determination step at the point 606. This determination is as to whether or not the purge cut valve 38C is moving from its open position toward its closed position. If the answer to this question is "yes", then the program proceeds to the point 608. Otherwise, the program proceeds to the end point 624 which corresponds to the point 430 of FIG. 18.

At the point 618 in the program, the value αm stored in the memory is updated by the feedback correction factor a calculated before the purge cut valve 38C moves toward its closed position. At the point 620, a determination is made as to whether or not the feedback correction factor average value αa is equal to or greater than an initial value α1 (100%). If the answer to this question is "yes", then the program proceeds to the point 612 where the feedback correction factor α is calculated as $\alpha=\alpha1+(\alpha m-\alpha1)\cdot H1$ where H1 is a predetermined constant. Following this, the program proceeds to the end point 624.

If αa<100%, then the program proceeds from the point 610 to the point 614 where the feedback correction factor α is calculated as $\alpha=\alpha1+(\alpha m-\alpha1)\cdot H2$ where H2 is a predetermined constant greater than the predetermined constant H1. Following this, the program proceeds to the end point 624.

If the purge cut valve 28C is closed, then the program proceeds from the point 604 to another determination step at the point 616. This determination is as to whether or not the purge cut valve 38C is moving from its closed position toward its open position. If the answer to this question is "yes", then the program proceeds to the point 618. Otherwise, the program proceeds to the end point 624. At the point 618 in the program, a determination is made as to whether or not the feedback correction factor average value $\alpha a$ is equal to or greater than the initial value $\alpha 1$ (100%). If the answer to this question is "yes", then the program proceeds to the point 620 where the feedback correction factor a is calculated as $\alpha=\alpha 1+(\alpha m-\alpha 1)\cdot H1$. Otherwise, the program proceeds to the point 622 where the feedback correction factor $\alpha$ is calculated as $\alpha=\alpha 1+(\alpha m-\alpha 1)\cdot H2$. Following this, the program proceeds to the end point 624.

Figure 31:
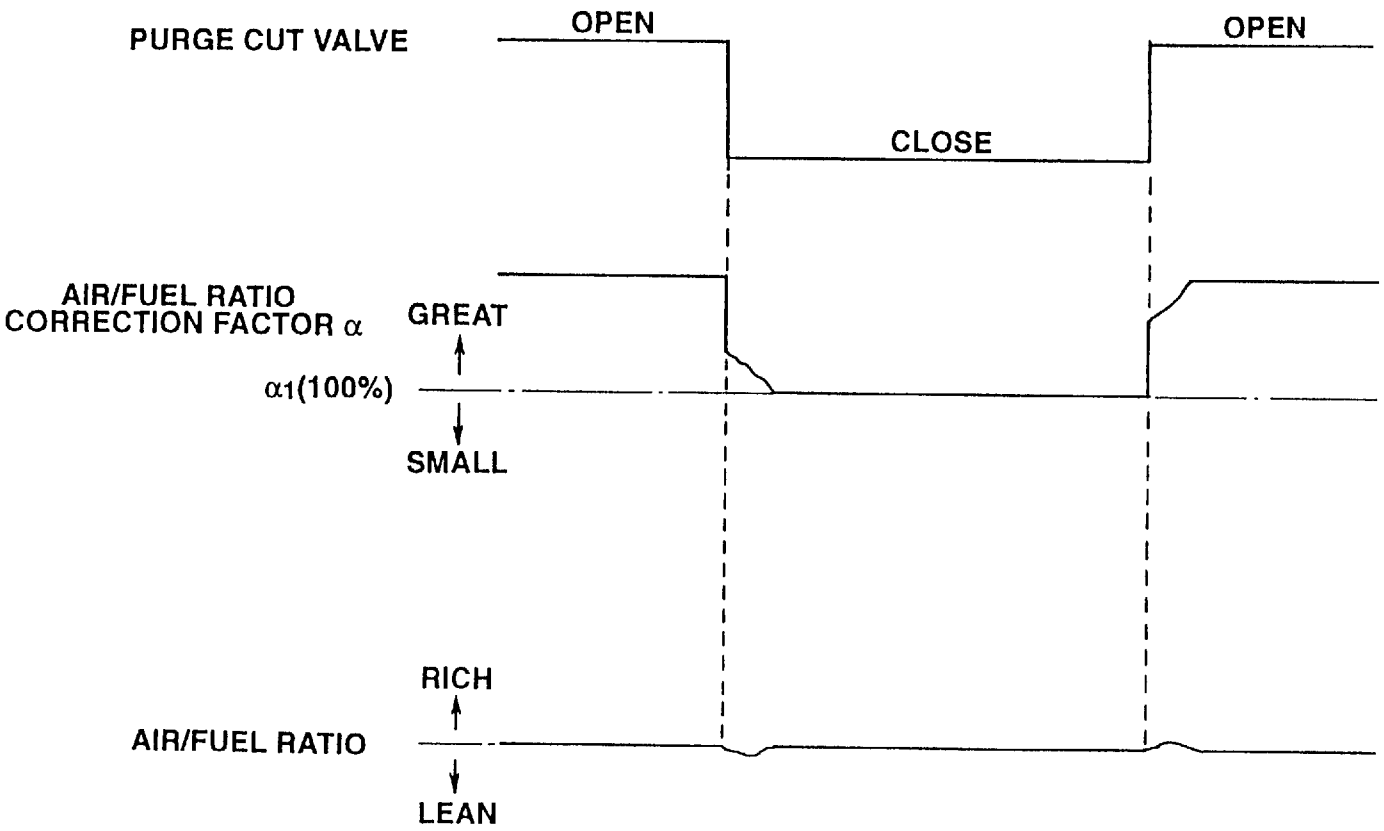
FIG. 31 contains graphs used in explaining the air/fuel ratio control operation.

When the purge cut valve 38C opens to permit flow of purge gases containing almost no fuel vapor into the induction passage, the average value xa of the feedback correction factor $\alpha$ is greater than the initial value $\alpha 1$ (100%) so as to correct the fuel-injection pulse-width Te to a value greater than the basic fuel-injection pulse-width value Ti. When the purge cut valve 38C closes to interrupt the introduction of the purge gases through the purge passage 35 into the induction passage 25, the feedback correction factor $\alpha$ is set at a value calculated as $\alpha=\alpha 1+(\alpha m-\alpha 1)\cdot H1$ in response to the purge cut valve closing movement. As a result, the PI control brings the value $(\alpha m-\alpha 1)\cdot H1$ by which the feedback correction factor is to be corrected closer to the initial value $\alpha 1$ (100%). The air/fuel ratio control can prevent the amount Te of fuel injected through the injector 23 from decreasing before the whole amount of purge gases containing almost no fuel vapor enters the cylinder so that the air/fuel ratio cannot be learned over stoichiometry, as shown in FIG. 31.

When the purge cut valve 38C is closed to terminate the supply of purge gases from the purge passage 35 into the induction passage 25, the feedback correction factor $\alpha$ is held about 100%. When the purge cut valve 38C opens to introduce the purge gases containing almost no fuel vapor through the purge passage 35 into the induction passage 25, the feedback correction factor $\alpha$ is set at a value calculated as $\alpha=\alpha 1+(\alpha m-\alpha 1)\cdot H2$ in response to the purge cut valve opening movement. As a result, the PI control brings the value $(\alpha m-\alpha 1)\cdot H2$ by which the feedback correction factor is to be corrected closer to the initial value $\alpha 1$ (100%). The air/fuel ratio control can prevent the amount Te of fuel injected through the injector 23 from increasing before the whole amount of purge gases containing almost no fuel vapor enters the cylinder so that the air/fuel ratio cannot be enriched over stoichiometry, as shown in FIG. 31.

Figure 32:
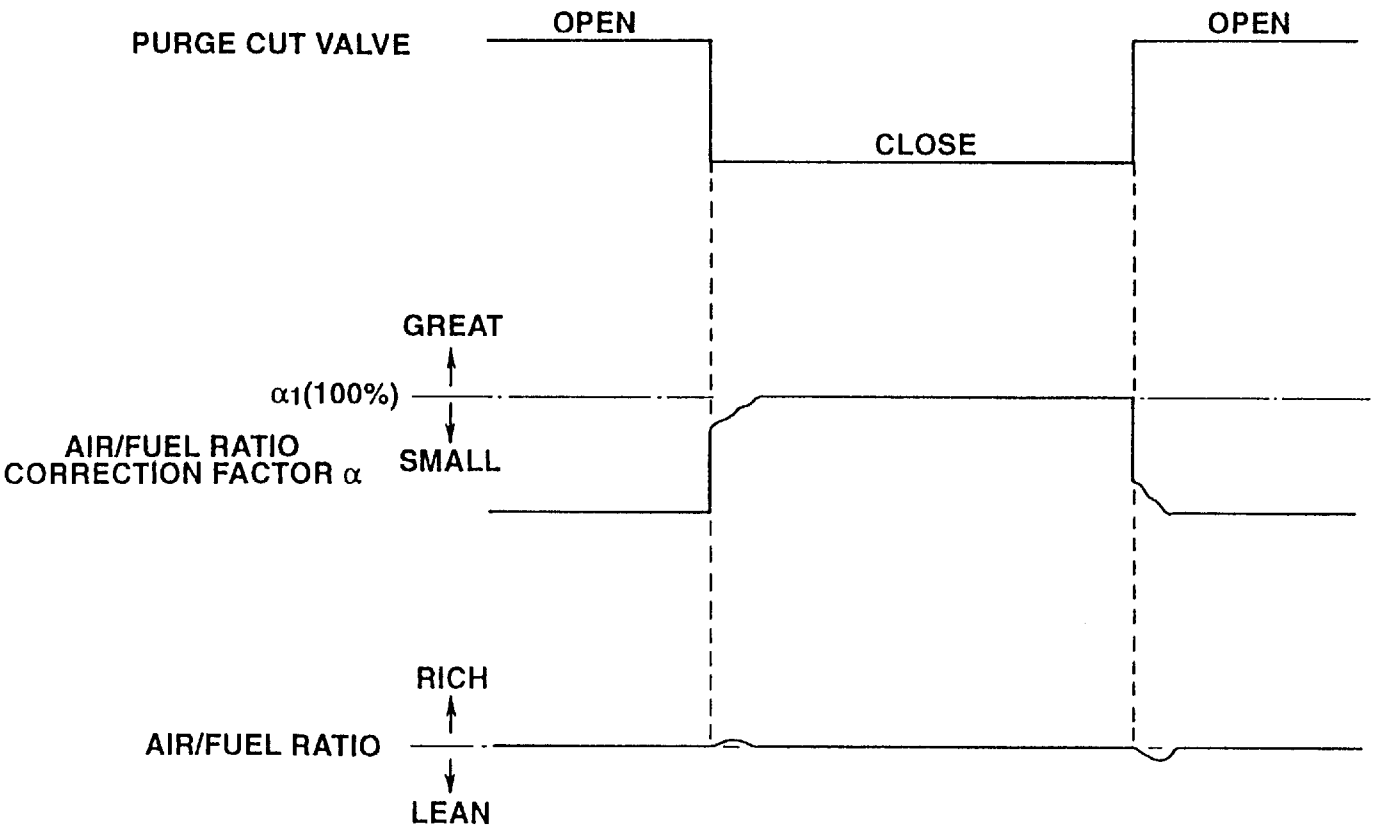
FIG. 32 contains graphs used in explaining the air/fuel ratio control operation.

When the purge cut valve 38C opens to permit flow of purge gases containing a great amount of fuel vapor into the induction passage, the average value $\alpha a$ of the feedback correction factor $\alpha$ is smaller than the initial value $\alpha 1$ (100%) so as to correct the fuel-injection pulse-width Te to a value less than the basic fuel-injection pulse-width value Ti. When the purge cut valve 38C closes to interrupt the introduction of the purge gases through the purge passage 35 into the induction passage 25, the feedback correction factor $\alpha$ is set at a value calculated as $\alpha=\alpha 1+(\alpha m-\alpha 1)\cdot H2$ in response to the purge cut valve closing movement. As a result, the PI control brings the value $(\alpha m-\alpha 1)\cdot H2$ by which the feedback correction factor is to be corrected closer to the initial value $\alpha 1$ (100%). The air/fuel ratio control can prevent the amount Te of fuel injected through the injector 23 from increasing before the whole amount of fuel vapor contained in the purge gases enters the cylinder so that the air/fuel ratio cannot be enrich over stoichiometry, as shown in FIG. 32.

When the purge cut valve 38C is closed to terminate the supply of purge gases from the purge passage 35 into the induction passage 25, the feedback correction factor $\alpha$ is held about 100%. When the purge cut valve 38C opens to introduce the purge gases containing a great amount of fuel vapor through the purge passage 35 into the induction passage 25, the feedback correction factor $\alpha$ is set at a value calculated as $\alpha=\alpha 1+(\alpha m-\alpha 1)\cdot H2$ in response to the purge cut valve opening movement. As a result, the PI control brings the value $(\alpha m-\alpha 1)\cdot H2$ by which the feedback correction factor is to be corrected closer to the initial value $\alpha 1$ (100%). The air/fuel ratio control can prevent the amount Te of fuel injected through the injector 23 from decreasing before the whole amount of purge gases containing almost no fuel vapor enters the cylinder so that the air/fuel ratio cannot be leaned over stoichiometry, as shown in FIG. 32.

Figure 33:
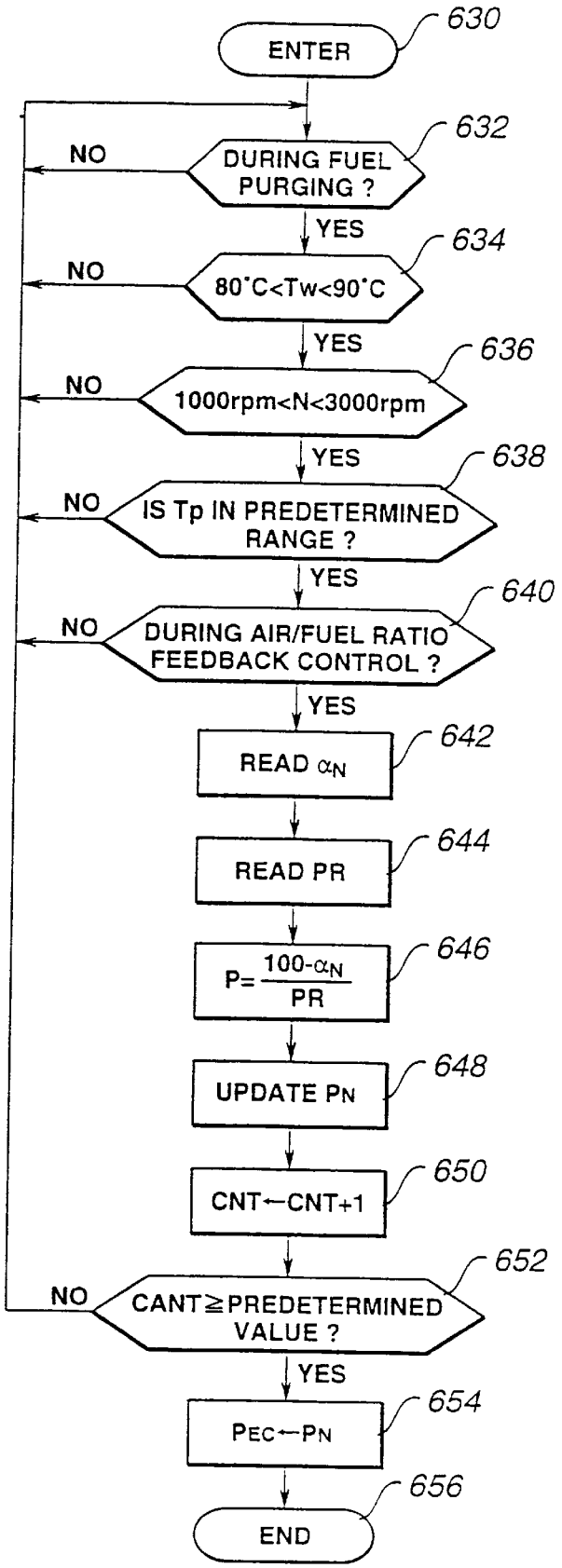
FIG. 33 is a flow diagram showing the programming of the digital computer as it is used to calculate a purge gas concentration corresponding parameter.

FIG. 33 is a flow diagram illustrating the programming of the digital computer as it is used to calculate the purge gas concentration corresponding parameter $P_{EC}$. The computer program is entered at the point 630 at uniform time intervals, for example, 1 second. At the point 632 in the program, a determination is made as to. whether or not the purging operation is performed. If the answer to this question is "yes", then the program proceeds to the point 634. Otherwise, the program is returned to the point 632. At the point 634, a determination is made as to whether or not the engine coolant temperature Tw is in a predetermined range, for example, 80° C.<Tw<90° C. If the answer to this question is "yes", then it means that the engine has been warmed and the program proceeds to the point 636. Otherwise, the program is returned to the point 632. At the point 636 in the program, a determination is made as to whether or not the engine speed is in a predetermined range, for example, 1000 rpm<N<3000 rpm. If the answer to this question is "yes", then the program proceeds to the point 638. Otherwise, the program is returned to the point 632. At the point 638 in the program, a determination is made as to whether or not the basic fuel-injection pulse-width value Tp is in a predetermined value. If the answer to this question is "yes", then it means that the intake manifold negative pressure is in a range of −400 mmHg to −250 mmHg and the program proceeds to the point 640. Otherwise, the program is returned to the point 632. At the point 640, a determination is made as to whether or not the air/fuel ratio feedback control is performed. If the answer to this question is "yes", then the program proceeds to the point 642. Otherwise, the program is returned to the point 632.

At the point 642, the weighted average value $\alpha_N$ [%] of the air/fuel ratio feedback correction factor $\alpha$ is read into the computer memory. The weighted average value $\alpha_N$ is calculated as $\alpha_N=\alpha\times K3\times\alpha_{N0}\times(1-K3)$ where K3 is a weighted average coefficient and $\alpha_{N0}$ is the last value of the weighted average. At the point 644 in the program, the purge rate PR (=PRO×K2) is read into the computer program. At the point 646, the purge gas concentration parameter P is calculated as $P=(1-\alpha_N)/PR$.

At the point 648 in the program, the weighted average value $P_N$ of the parameter P is updated as $P_N=P\times K4+P_{N0}\times(1-K4)$ where K4 is a weighted average coefficient and $P_{N0}$ is the last value of the weighted average $P_N$. At the point 650, the count CNT, which indicates the number of times the weighted average $P_N$ is updated, is incremented by one step.

At the point 652 in the program, a determination is made as to whether or not the count CNT is equal to or greater than a predetermined value. If the answer to this question is "yes", then the program proceeds to the point 654. Otherwise, the program is returned to the point 632. At the point 654, the weighted average value $P_N$ is shifted to a variable $P_{EC}$. Following this, the program proceeds to the end point 656.

Figure 34A:
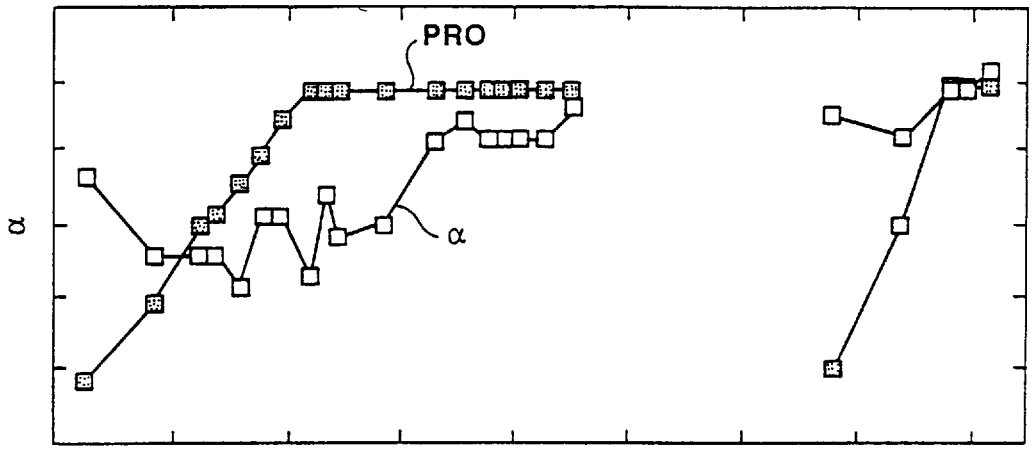
FIGS. 34A–C contain graphs used in explaining the air/fuel ratio control operation.
Figure 34B:
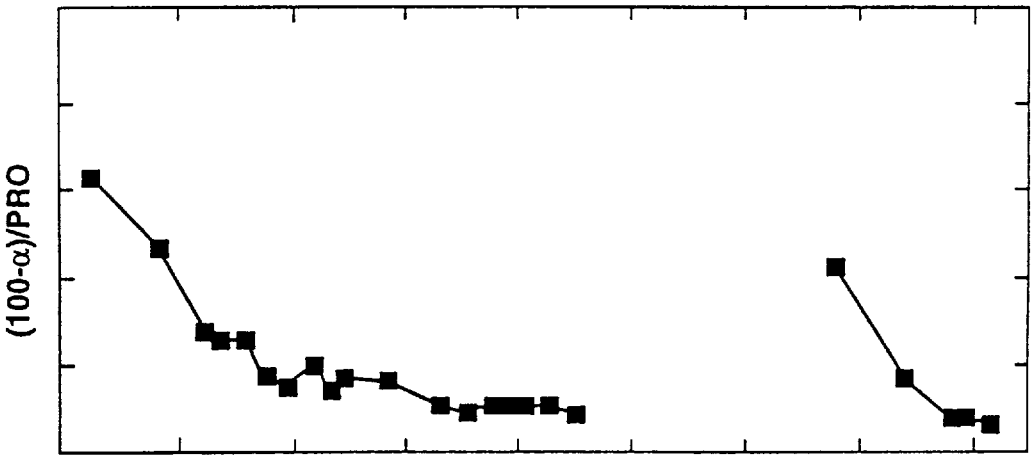
Figure 34C:
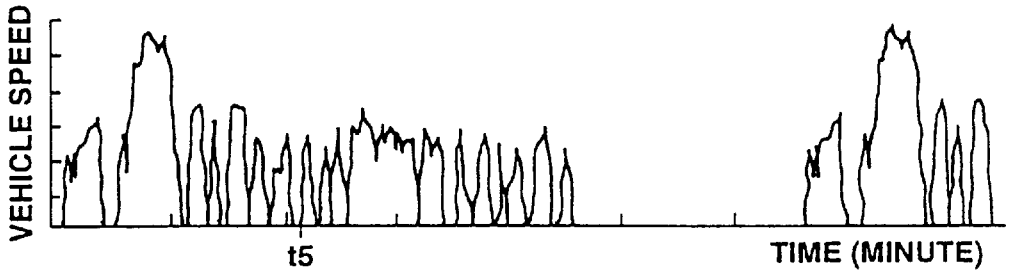

FIG. 34 shows variations in the air/fuel ratio feedback correction factor α, the purge rate PR and the purge gas concentration corresponding parameter P in a test mode where a great amount of fuel vapor is absorbed in the canister 31. In FIG. 34, the average value of the air/fuel ratio feedback correction factors during the interval between the time at which the vehicle speed increases from zero and decreases to zero is represented as α. If the purge control valve opens for the same purge rate as obtained a predetermined time t5 after the fuel purge starts, the air/fuel ratio will be enriched to a great extent due to purge gases having a high concentration just after the fuel purge starts. Therefore, the purge rate is set at a small value just after the fuel purge starts and thereafter it is increased gradually until the predetermined time t5. For this reason, the value (1−α) is held substantially at a constant value for the predetermined time t5 after the fuel purge starts.

If the purge gas concentration corresponding value is estimated as a value (1−α) or a value proportional to (1−α) even when the purge rate changes, an error will be introduced into. the estimation. The actual purge gas concentration is at maximum just after the fuel purge starts, as shown in FIG. 34, and it decreases as the fuel vapor purging operation progresses. Upon completion of the fuel vapor purging operation, the actual purge gas concentration is held at a certain small value. However, the value (1−α) does not correspond to such changes. In this embodiment, the purge gas concentration corresponding parameter P is calculated as the value (1−α) divided by the purge rate PR. This parameter P is at maximum just after the fuel purge starts and it decreases as the fuel vapor purging operation progresses. Upon completion of the fuel vapor purging operation, the parameter P is held at a certain small value. Thus, the parameter P corresponds to the changes in the actual purge gas concentration.

The purge gas concentration can be estimated with high accuracy even when the purge rate is changing. When the purge gases having a high concentration is introduced just after the fuel purge starts, the fuel purge operation continues until the purge gas concentration corresponding parameter P decreases below a predetermined value, that is, until the purge gas concentration decreases below a predetermined value. When the purge gas concentration decreases below a predetermined value as the purge operation progresses, the leakage check is made. Therefore the fuel purge operation cannot be resumed, in the presence of a great amount of fuel vapor produced in the fuel tank and absorbed in the canister, at the termination of the leakage checking operation. This is effective to prevent the air/fuel ratio enrichment causing increased CO and HC emissions.

What is claimed is:

1. A system for controlling the ratio of air and fuel supplied to an internal combustion engine during purging of accumulated evaporated fuel from a fuel tank, comprising:

a purge valve for regulating the supply of a gaseous mixture including evaporated fuel to said internal combustion engine;

a processor for determining a purge rate factor corresponding to a concentration of evaporated fuel in said gaseous mixture;

a controller for controlling said purge valve to regulate the rate of supply of said gaseous mixture to the internal combustion engine in accordance with said purge rate;

a sensor for sensing the temperature of fuel in the fuel tank;

the controller corresponding said concentration of evaporated fuel in said gaseous mixture to said sensed temperature.

2. A system according to claim 1, wherein said purge valve is adapted to regulate a rate of flow of said gaseous mixture to said internal combustion engine.

3. A system according to claim 1, wherein said purge valve is adapted to supply said gaseous mixture to said internal combustion engine at a first rate if said concentration is low and at a second rate which is less than the first rate if said concentration is high.

4. A system according to claim 1, wherein said controller is adapted to control said purge valve to vary the rate of supply of said gaseous mixture to the internal combustion engine during purging of accumulated evaporated fuel in relation to a change in the concentration of evaporated fuel in said gaseous mixture during said purging.

5. A method for controlling the ratio of air and fuel supplied to an internal combustion engine during purging of accumulated evaporated fuel from a fuel tank, comprising the steps of:

determining a purge rate factor corresponding to a concentration of evaporated fuel in said gaseous mixture;

controlling a rate of supply of said gaseous mixture to the internal combustion engine in accordance with said purge rate factor;

sensing the temperature of fuel in the fuel tank; and utilizing said sensed temperature to determine the concentration of evaporated fuel in said gaseous mixture.

6. A method according to claim 5, wherein said supply of said gaseous mixture to said internal combustion engine is at a first rate if said concentration is low and at a second rate which is less than the first rate if said concentration is high.

7. A method according to claim 5, wherein said rate of supply of said gaseous mixture to the internal combustion engine is varied during purging of accumulated evaporated fuel in relation to a change in the concentration of evaporated fuel in said gaseous mixture during said purging.

* * * * *